US011049464B2

(12) United States Patent
Fujikawa

(10) Patent No.: US 11,049,464 B2
(45) Date of Patent: Jun. 29, 2021

(54) ELECTRO-OPTICAL DEVICE FOR PRE-CHARGING SIGNAL LINES AND DRIVING METHOD THEREOF

(71) Applicant: SEIKO EPSON CORPORATION, Tokyo (JP)

(72) Inventor: Shinsuke Fujikawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/687,003

(22) Filed: Nov. 18, 2019

(65) Prior Publication Data

US 2020/0160804 A1 May 21, 2020

(30) Foreign Application Priority Data

Nov. 19, 2018 (JP) ..... JP2018-216415

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01); *G09G 3/3696* (2013.01); *G09G 2310/0251* (2013.01); *G09G 2310/0297* (2013.01); *G09G 2310/08* (2013.01)

(58) Field of Classification Search
CPC ..... G09G 3/3614
USPC ..... 345/96
See application file for complete search history.

(56) References Cited

U.S. PATENT DOCUMENTS

2006/0221701 A1* 10/2006 Sun ..... G09G 3/3648 365/185.22
2010/0073341 A1 3/2010 Toyooka et al.
2015/0154926 A1 6/2015 Fujikawa
2018/0158431 A1 6/2018 Fujikawa
2019/0318700 A1* 10/2019 Iwase ..... G09G 3/3614

FOREIGN PATENT DOCUMENTS

JP 2007-093996 A 4/2007
JP 2010-072393 A 4/2010
JP 2015-106108 A 6/2015
JP 2018-092140 A 6/2018

* cited by examiner

*Primary Examiner* — Long D Pham
(74) *Attorney, Agent, or Firm* — Oliff PLC

(57) ABSTRACT

An electro-optical device includes a first signal line, a second signal line, and a third signal line, a signal line drive circuit configured to supply a first image signal, a polarity of which is inverted with reference to a predetermined voltage in a predetermined cycle, to the first signal line in a first writing period, supply a second image signal to the second signal line in a second writing period, and supply a third image signal to the third signal line in a third writing period, a pre-charge circuit that includes a one-channel type transistor and is configured to supply a pre-charge signal to the third signal line in a pre-charge period overlapping the second writing period, and a timing control circuit configured to change a start timing of the pre-charge period in accordance with a polarity of the first image signal.

9 Claims, 11 Drawing Sheets

ELECTRO-OPTICAL DEVICE FOR PRE-CHARGING SIGNAL LINES AND DRIVING METHOD THEREOF

The present application is based on, and claims priority from JP Application Serial Number 2018-216415, filed Nov. 19, 2018, the disclosure of which is hereby incorporated by reference herein in its entirety.

BACKGROUND

1. Technical Field

The present disclosure relates to an electro-optical device, a driving method for the electro-optical device, and an electronic apparatus.

2. Related Art

An electro-optical device configured to display an image by using a liquid crystal element supplies a video voltage based on an image signal specifying a gradation of each pixel to each pixel via a signal line, to control such that transmittance of a liquid crystal included in each pixel is set to a transmittance based on the video voltage. As a result, the gradation of each pixel is set to the gradation specified by the image signal.

When writing of the video voltage to each pixel is insufficient, such as in a case in which time for supplying the video voltage to each pixel cannot be sufficiently secured, each pixel may not be able to accurately display the gradation specified by the image signal. Thus, in a typical electro-optical device, for example, by performing pre-charge for previously charging a signal line to a predetermined voltage level, insufficient writing of the video voltage for each pixel is prevented. For example, JP-A-2015-106108 discloses an electro-optical device that simultaneously performs pre-charge for some of a plurality of signal lines and writing of a video voltage to pixels in one horizontal scanning period.

However, a voltage of a pre-charge signal is different in positive writing and negative writing. Thus, when an N-channel type transistor is used as a pre-charge selection transistor that controls a supply to a signal line of the pre-charge signal, there is a problem that it is more difficult to write the pre-charge signal in positive writing having a small potential difference between a gate potential of the pre-charge selection transistor and the pre-charge signal than in negative writing.

SUMMARY

In order to solve the above-described problem, an aspect of an electro-optical device according to the present disclosure includes a first signal line, a second signal line, and a third signal line, a signal line drive circuit configured to supply a first image signal, a polarity of which is inverted with reference to a predetermined voltage in a predetermined cycle, to the first signal line in a first writing period, supply a second image signal, a polarity of which is inverted with reference to the predetermined voltage in a predetermined cycle, to the second signal line in a second writing period after the first writing period, and supply a third image signal, a polarity of which is inverted with reference to the predetermined voltage in a predetermined cycle, to the third signal line in a third writing period after the second writing period, a pre-charge circuit that includes a one-channel type transistor and is configured to supply a pre-charge signal to the third signal line in a pre-charge period overlapping the second writing period, and a timing control circuit configured to change a start timing of the pre-charge period in accordance with the polarity of the first image signal.

Further, an aspect of an electro-optical device according to the present disclosure includes a first signal line, a second signal line, and a third signal line, a signal line drive circuit configured to supply a first image signal, a polarity of which is inverted with reference to a predetermined voltage in a predetermined cycle, to the first signal line in a first writing period, supply a second image signal, a polarity of which is inverted with reference to the predetermined voltage in a predetermined cycle, to the second signal line in a second writing period after the first writing period, and supply a third image signal, a polarity of which is inverted with reference to the predetermined voltage in a predetermined cycle, to the third signal line in a third writing period after the second writing period, a pre-charge circuit that includes a one-channel type transistor and is configured to supply a pre-charge signal to the third signal line in a pre-charge period overlapping the second writing period, and a timing control circuit configured to change a length of the pre-charge period in accordance with the polarity of the first image signal.

Further, an aspect of a driving method of an electro-optical device according to the present disclosure that includes a first signal line, a second signal line, and a third signal line, a signal line drive circuit configured to supply a first image signal, a polarity of which is inverted with reference to a predetermined voltage in a predetermined cycle, to the first signal line in a first writing period, supply a second image signal, a polarity of which is inverted with reference to the predetermined voltage in a predetermined cycle, to the second signal line in a second writing period after the first writing period, and supply a third image signal, a polarity of which is inverted with reference to the predetermined voltage in a predetermined cycle, to the third signal line in a third writing period after the second writing period, and a pre-charge circuit that includes a one-channel type transistor and is configured to supply a pre-charge signal to the third signal line in a pre-charge period overlapping the second writing period, the driving method of an electro-optical device including changing a start timing of the pre-charge period in accordance with the polarity of the first image signal.

Further, an aspect of a driving method of an electro-optical device according to the present disclosure that includes a first signal line, a second signal line, and a third signal line, a signal line drive circuit configured to supply a first image signal, a polarity of which is inverted with reference to a predetermined voltage in a predetermined cycle, to the first signal line in a first writing period, supply a second image signal, a polarity of which is inverted with reference to the predetermined voltage in a predetermined cycle, to the second signal line in a second writing period after the first writing period, and supply a third image signal, a polarity of which is inverted with reference to the predetermined voltage in a predetermined cycle, to the third signal line in a third writing period after the second writing period, and a pre-charge circuit that includes a one-channel type transistor and is configured to supply a pre-charge signal to the third signal line in a pre-charge period overlapping the second writing period, the driving method of an electro-optical device including changing a length of the pre-charge period in accordance with the polarity of the first image signal.

DESCRIPTION OF EXEMPLARY EMBODIMENTS

Exemplary Embodiment

Figure 1:
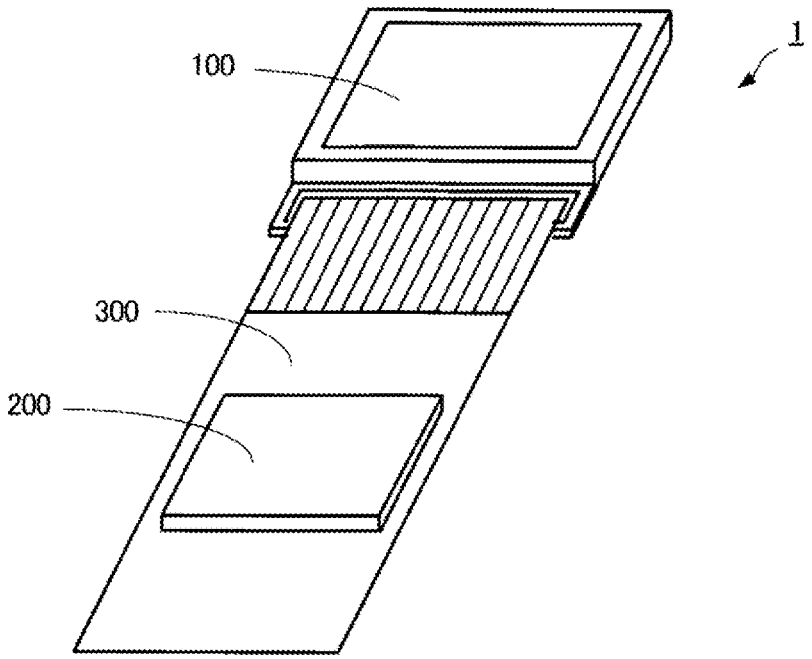
FIG. 1 is an explanatory diagram of an electro-optical device according to an exemplary embodiment of the present disclosure.

An exemplary embodiment of the present disclosure will be described below with reference to FIG. 1 to FIG. 8. FIG. 1 is an explanatory diagram of an electro-optical device 1 according to the exemplary embodiment of the present disclosure. Note that FIG. 1 illustrates a configuration of a signal transmission system for the electro-optical device 1. The electro-optical device 1 includes an electro-optical panel 100, a drive integrated circuit 200 such as a driver IC (Integrated Circuit), and a flexible printed wired board 300. The electro-optical panel 100 is coupled to the flexible printed wired board 300 on which the drive integrated circuit 200 is mounted. Further, the electro-optical panel 100 is coupled to a host CPU (Central Processing Unit) device, which is not illustrated, via the flexible printed wired board 300 and the drive integrated circuit 200. The drive integrated circuit 200 is a device that receives an image signal and various control signals for drive control from the host CPU device via the flexible printed wired board 300, and drives the electro-optical panel 100 via the flexible printed wired board 300.

Figure 2:
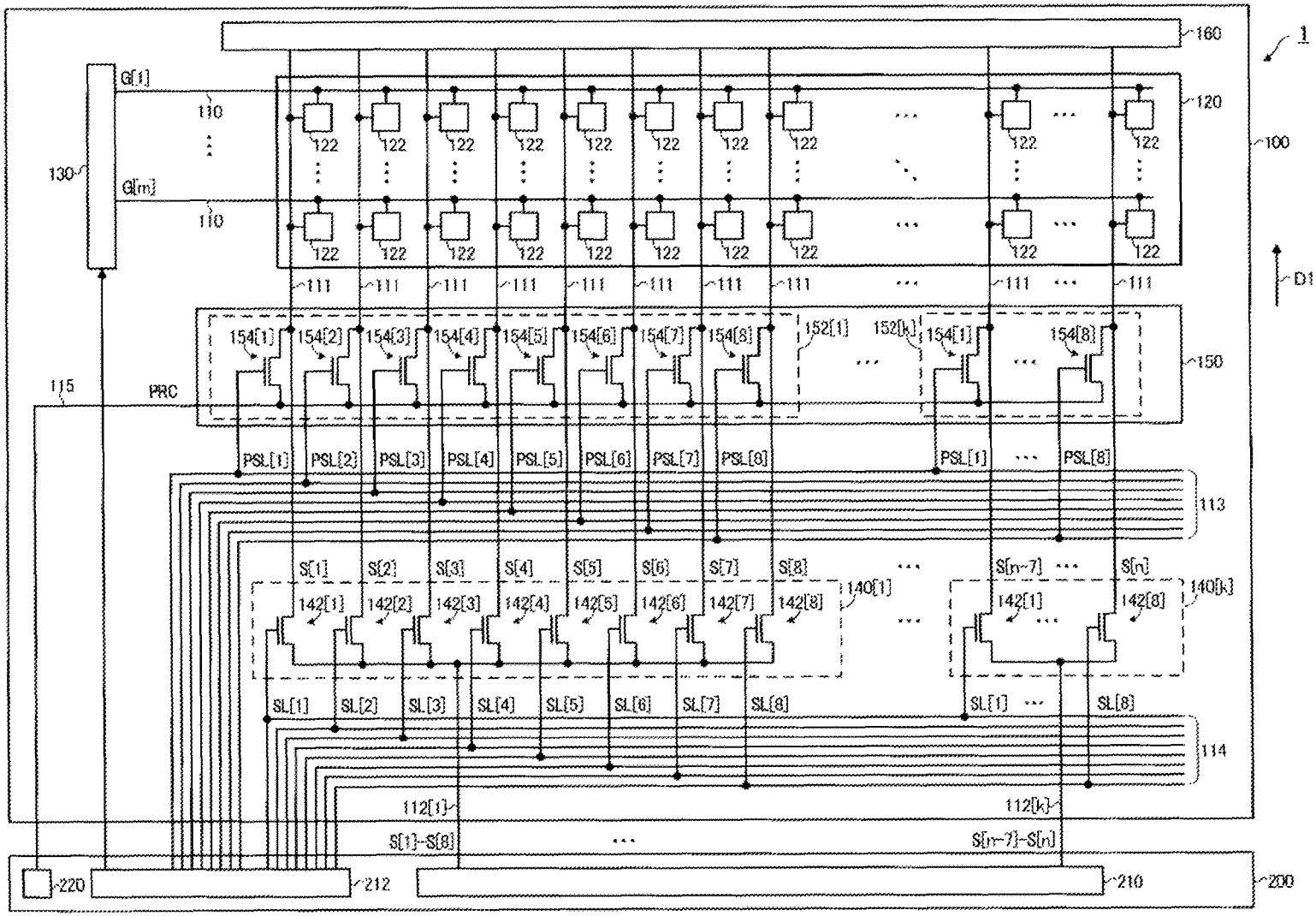
FIG. 2 is a block diagram illustrating a configuration of the electro-optical device.
Figure 3:
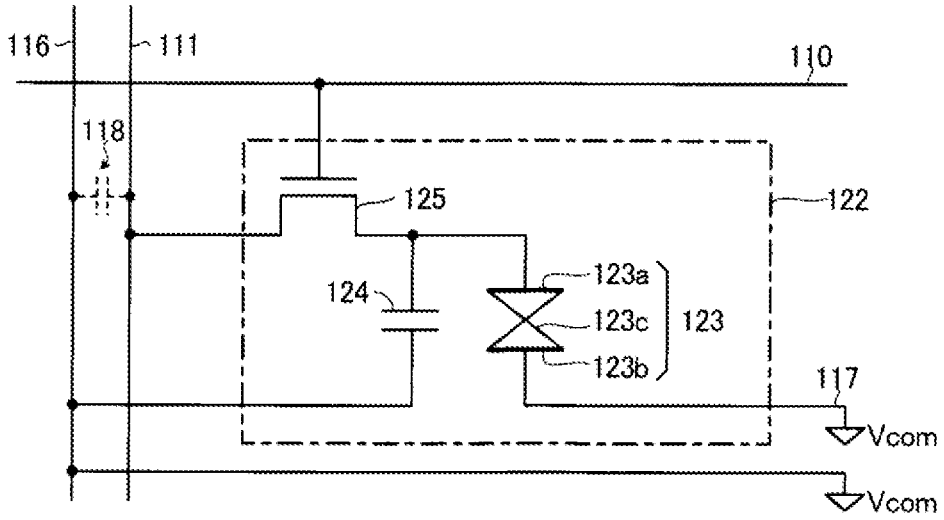
FIG. 3 is a circuit diagram illustrating a configuration of a pixel.

FIG. 2 is a block diagram illustrating a configuration of the electro-optical device 1. The electro-optical panel 100 of the electro-optical device 1 includes m scanning lines 110, n signal lines 111, a display region 120, a scanning line drive circuit 130, k demultiplexers 140[1] to 140[*k*], a pre-charge circuit 150, and an inspection circuit 160. Note that m, n, and k are natural numbers. In the example illustrated in FIG. 2, since the n signal lines 111 are classified into k signal line groups each of which includes eight signal lines 111, k is a value obtained by dividing n by 8. Further, the electro-optical panel 100 includes, in addition to the m scanning lines 110 and the n signal lines 111, k data lines 112, a pre-charge control signal line 113, a write selection signal line 114, a pre-charge power supply line 115, a capacitance line 116 and a common line 117 illustrated in FIG. 3, and the like. Note that, in FIG. 2, description of the capacitance line 116 and the common line 117 illustrated in FIG. 3 is omitted in FIG. 2 for ease of illustration. The drive integrated circuit 200 of the electro-optical device 1 includes a data line drive circuit 210, a control circuit 212, and a pre-charge power supply 220.

The display region 120 is a region in which an image is displayed. For example, the display region 120 includes a pixel 122 that is provided corresponding to each of intersections of the m scanning lines 110 and the n signal lines 111. As illustrated in FIG. 3, the pixel 122 includes a liquid crystal element 123 including a liquid crystal 123*c* whose transmittance changes depending on an applied voltage. Since the transmittance of the liquid crystal 123*c* changes depending on the voltage applied to the liquid crystal 123*c*, a display gradation of the pixel 122 changes. In FIG. 2, a row of the pixels 122 illustrated on a topmost side of the figure is a first row, and a column of the pixels 122 illustrated on a leftmost side of the figure is a first column.

Note that, in the electro-optical device 1, in order to prevent electrical degradation of an electro-optical material, polarity inversion driving is employed in which a polarity of the voltage applied to the liquid crystal element 123 is inverted every constant cycle. For example, the electro-optical device 1 inverts a level of an image signal S to be supplied to the pixel 122 via the signal line 111 every one vertical scanning period with respect to a center voltage of the image signal S. Note that the cycle for inverting the polarity can be arbitrarily set, and, for example, may be set to a natural number multiple of the vertical scanning period. In the present specification, a polarity in a case in which a voltage of the image signal S is high with respect to a predetermined voltage such as the center voltage is referred to as a positive polarity, and a polarity in a case in which the voltage of the image signal S is low with respect to the predetermined voltage is referred to as a negative polarity.

The scanning line drive circuit 130 generates scanning signals G[1] to G[m] based on a control signal received from the control circuit 212 of the drive integrated circuit 200, and outputs the scanning signals G[1] to G[m] to the respective m scanning lines 110. For example, the scanning line drive circuit 130 sequentially activates the scanning signals G[1] to G[m] for the respective scanning lines 110 in a vertical scanning period for each horizontal scanning period. Note that, for example, a scanning signal G is activated in a period in which the scanning signal G is maintained at a selected voltage at a high level and the like, and is deactivated in a period in which the scanning signal G is maintained at a non-selected voltage at a low level and the like.

Specifically, in a period in which a scanning signal G[p] corresponding to a p-th row is maintained at the selected voltage, the scanning line 110 corresponding to the p-th row is in a selected state, and each of the liquid crystals 123*c* included in the respective n pixels 122 in the p-th row is electrically coupled to each of the n signal lines 111. Note that p is a natural number from 1 to m. Further, in a period in which the scanning signal G[p] is maintained at the non-selected voltage, the scanning line 110 corresponding to the p-th row is in a non-selected state, and an electrical coupling state between each of the liquid crystals 123*c* included in the respective n pixels 122 in the p-th row and each of the n signal lines 111 is a non-conductive state.

The k demultiplexers 140[1] to 140[*k*] correspond to the respective k signal line groups. For example, each of the k demultiplexers 140[1] to 140[*k*] receives the image signal S that is supplied from the data line drive circuit 210 to each of the k data lines 112[1] to 112[*k*]. Note that, in the present exemplary embodiment, the signal lines 111 are divided in units of eight lines, so the image signal S for eight pixels is supplied to the one data line 112 in a time-division manner from the data line drive circuit 210. Accordingly, each of the demultiplexers 140 supplies the image signal S to the eight signal lines 111 included in a corresponding signal line group in a time-division manner.

Each of the demultiplexers 140 has eight writing selection transistors 142[1] to 142[8] coupled to the respective eight signal lines 111 included in the corresponding signal line group. In other words, when assuming that i is a natural number from 1 to k, one contact of each of the eight writing selection transistors 142[1] to 142[8] of a demultiplexer 140[*i*] is coupled to each of the eight signal lines 111 that are in an 8×i−7-th column to an 8×i-th column. Further, the other contact of each of the eight writing selection transistors 142[1] to 142[8] of the demultiplexer 140[*i*], that is, the contact that is not coupled to the signal line 111, is commonly coupled to the data line 112[*i*]. The k data lines 112[1] to 112[*k*] are coupled to the data line drive circuit 210 of the drive integrated circuit 200 via the flexible printed wired board 300.

The writing selection transistors 142[1] to 142[8] of the demultiplexer 140[*i*] switch an electrical coupling state between the signal line 111 and the data line 112[*i*] between a conductive state and a non-conductive state in accordance with the write selection signals SL[1] to SL[8]. For example, the writing selection transistors 142[1] to 142[8] are N-channel type transistors constituted by TFTs (thin film transistors) or the like, and are set to either the conductive state or the non-conductive state depending on levels of the write selection signals SL[1] to SL[8] received by control terminals of a gate and the like. In other words, in the example illustrated in FIG. 2, the writing selection transistors 142[1] to 142[8] are N-channel type transistors that receive the image signal S at one of the source and the drain and have the other coupled to the signal line 111.

Note that the writing selection transistors 142[1] to 142[8] may be a switching element other than TFTs. Further, the writing selection transistors 142[1] to 142 [8] may be P-channel type transistors. Hereinafter, a writing selection transistor 142[*j*] controlled by a write selection signal SL[j] is also referred to as a writing selection transistor 142 in a j-th sequence. Note that j is a natural number from 1 to 8. Further, the signal line 111 coupled to the writing selection transistor 142[*j*] in the j-th sequence is also referred to as the signal line 111 in the j-th sequence. Accordingly, a number or the like in square brackets of a reference sign of the write selection signal SL corresponds to a sequence number of the signal line 111 to be controlled. Similarly, a number or the like in square brackets of a pre-charge control signal PSL, which will be described later, also corresponds to a sequence number of the signal line 111 to be controlled. The signal line 111 in one sequence among the signal lines 111 in three mutually different sequences is an example of a first signal line, the signal line 111 in one of the other two sequences is an example of a second signal line, and the signal line 111 in the remaining sequence is an example of a third signal line. Further, the writing selection transistor 142 coupled to the signal line 111 in one of three mutually different sequences is an example of a first N-channel type transistor. Then, the writing selection transistor 142 coupled to the signal line 111 in one of the other two sequences is an example of a second N-channel type transistor, and the writing selection transistor 142 coupled to the signal line 111 in the remaining sequence is an example of a third N-channel type transistor.

Figure 4:
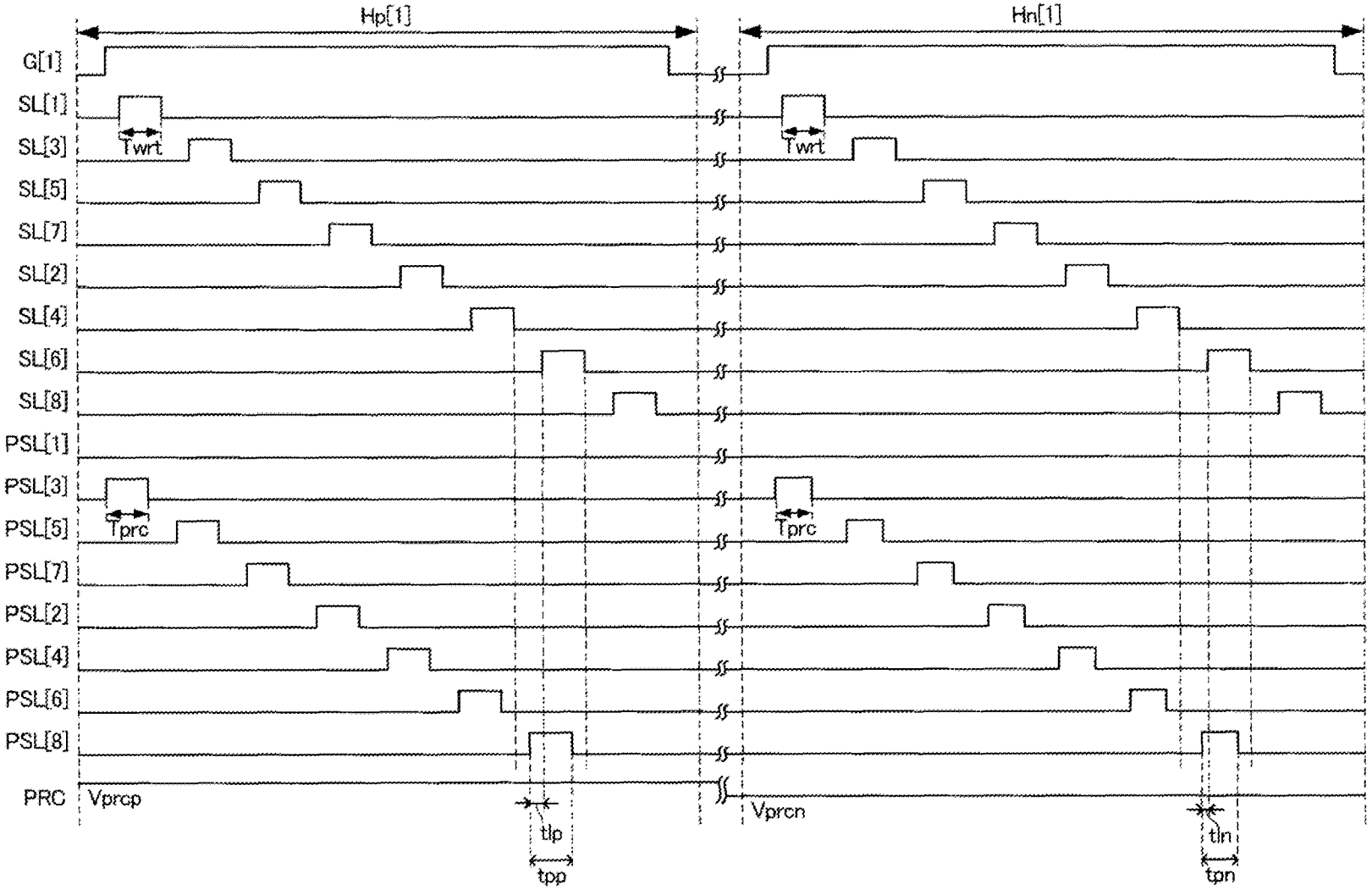
FIG. 4 is a timing chart illustrating an overview of an operation of the electro-optical device.

The eight writing selection transistors 142[1] to 142[8] of each of the demultiplexers 140 respectively receive the write selection signals SL[1] to SL[8] from the control circuit 212 of the drive integrated circuit 200 via the respective write selection signal lines 114. The write selection signal line 114 is coupled to the control circuit 212 of the drive integrated circuit 200 via the flexible printed wired board 300. As illustrated in FIG. 4 and the like, the write selection signals SL[1] to SL[8] define a writing period Twrt for supplying the image signal S to the respective signal lines 111.

For example, a period in which the write selection signal SL[j] received by the writing selection transistor 142[*j*] in the j-th sequence is maintained at a selected voltage at a high level and the like is the writing period Twrt for supplying the image signal S to the signal line 111 in the j-th sequence. Hereinafter, the writing period Twrt for supplying the image signal S to the signal line 111 in the j-th sequence is also referred to as the writing period Twrt in the j-th sequence. When the signal line 111 in the j-th sequence is an example of the first signal line, the writing period Twrt in the j-th sequence is an example of a first writing period. When the signal line 111 in the j-th sequence is an example of the second signal line, the writing period Twrt in the j-th sequence is an example of a second writing period. When the signal line 111 in the j-th sequence is an example of the third signal line, the writing period Twrt in the j-th sequence is an example of a third writing period.

Specifically, when one write selection signal SL[1] is at the high level and the other seven write selection signals SL[2] to SL[8] are at the low level, only the k writing selection transistors 142[1] included in the respective k demultiplexers 140[1] to 140[*k*] are brought into the conductive state. Accordingly, each of the k demultiplexers 140[1] to 140[*k*] outputs the image signal S supplied to each of the k data lines 112, to the signal line 111 in the first sequence of each of the signal line groups. Hereinafter, similarly, each of the k demultiplexers 140[1] to 140[*k*] outputs the image signal S supplied to each of the k data lines 112, to the respective signal lines 111 in a second sequence, a third sequence, a fourth sequence, a fifth sequence, a sixth sequence, a seventh sequence, and an eighth sequence in each of the signal line groups.

The pre-charge circuit 150 supplies a pre-charge signal PRC to the n signal lines 111 in a predetermined order based on the pre-charge control signals PSL[1] to PSL[8]. Note that the pre-charge signal PRC is supplied from the pre-charge power supply 220 to the pre-charge circuit 150 via the pre-charge power supply line 115. Further, the pre-charge control signals PSL[1] to PSL[8] are supplied from the control circuit 212 to the pre-charge circuit 150 via the respective pre-charge control signal lines 113. Note that, in the present exemplary embodiment, the signal lines 111 are divided into the eight sequences, so the number of the pre-charge control signal lines 113 is eight.

For example, the pre-charge circuit 150 includes k pre-charge selection circuits 152[1] to 152[*k*] provided corresponding to the respective k signal line groups. Then, each pre-charge selection circuit 152 includes eight pre-charge selection transistors 154[1] to 154[8] each of which is coupled to each of the eight signal lines 111 included in a corresponding signal line group. In other words, a pre-charge selection transistor 154 is provided corresponding to the signal line 111. For example, one contact of each of the eight pre-charge selection transistors 154[1] to 154[8] of a pre-charge selection circuit 152[*i*] is coupled to each of the eight signal lines 111 that are in an 8×i−7-th column to an 8×i-th column. In addition, the other contact of each of the eight pre-charge selection transistors 154[1] to 154[8] of the pre-charge selection circuit 152[*i*], that is, the contact not coupled to the signal line 111, is commonly coupled to the pre-charge power supply line 115. The pre-charge power supply line 115 is coupled to the pre-charge power supply 220 of the drive integrated circuit 200 via the flexible printed wired board 300.

The pre-charge selection transistors 154[1] to 154[8], in response to the respective pre-charge control signals PSL[1] to PSL[8], switch an electrical coupling state between each of the signal lines 111 and the pre-charge power supply line 115 between the conductive state and the non-conductive state. For example, each of the pre-charge selection transistors 154[1] to 154[8] is an N-channel type transistor constituted by a TFT or the like, and is set to either the conductive state or the non-conductive state in accordance with a level of the pre-charge control signal PSL received by a control terminal of a gate and the like. In other words, in the example illustrated in FIG. 2, the pre-charge selection transistors 154[1] to 154[8] are N-channel type transistors that receive the pre-charge signal PRC at one of the source and the drain and have the other coupled to the signal line 111. Note that the pre-charge selection transistors 154[1] to 154[8] may be a switching element other than TFTs.

The respective pre-charge selection transistors 154[1] to 154[8] of each of the pre-charge selection circuits 152 receive the pre-charge control signals PSL[1] to PSL[8] via the pre-charge control signal lines 113 from the control circuit 212 of the drive integrated circuit 200. The pre-charge control signal line 113 is coupled to the control circuit 212 of the drive integrated circuit 200 via the flexible printed wired board 300. As illustrated in FIG. 4 and the like, each of the pre-charge control signals PSL[1] to PSL[8] defines a pre-charge period Tprc for supplying the pre-charge signal PRC to the signal line 111. For example, a period in which a pre-charge control signal PSL[j] received by a pre-charge selection transistor 154[*j*] in the j-th sequence is maintained at a selected voltage at a high level and the like is the pre-charge period Tprc for supplying the pre-charge signal PRC to the signal line 111 in the j-th sequence.

Specifically, when one pre-charge control signal PSL[1] is at the high level and the other seven pre-charge control signals PSL[2] to PSL[8] are at the low level, only the k pre-charge selection transistors 154[1] included in the respective k pre-charge selection circuits 152[1] to 152[*k*] are brought into the conductive state. Accordingly, each of the k pre-charge selection circuits 152[1] to 152[*k*] outputs the pre-charge signal PRC supplied to the pre-charge power supply line 115 to the signal line 111 in the first sequence of a corresponding signal line group. Hereinafter, similarly, each of the k pre-charge selection circuits 152[1] to 152[*k*] outputs the pre-charge signal PRC supplied to the pre-charge power supply line 115 to the signal lines 111 in the second sequence, the third sequence, the fourth sequence, the fifth sequence, the sixth sequence, the seventh sequence, and the eighth sequence of a corresponding signal line group. In other words, the pre-charge circuit 150 supplies the pre-charge signal PRC to the signal line 111 in the j-th sequence in the pre-charge period Tprc defined by the pre-charge control signal PSL[j].

The inspection circuit 160 inspects disconnection of the signal line 111, a short circuit of the signal lines 111 adjacent to each other, and the like in an inspection operation for inspecting the n signal lines 111. In the inspection operation, an electrical coupling state between the inspection circuit 160 and the n signal lines 111 is set to the conductive state. In a normal operation in which an image is displayed in accordance with the image signal S, an electrical coupling state between the inspection circuit 160 and the n signal lines 111 is set to the non-conductive state. Note that, in FIG. 2, description of inspection used for inspecting the signal line 111 is omitted for ease of illustration.

In the electro-optical panel 100 illustrated in FIG. 2, when a direction in which a single signal line 111 extends with, as a starting point, an input end of the image signal S in the single signal line 111 among the plurality of signal lines 111 is a first direction D1, the inspection circuit 160 is disposed on a side in the first direction D1 with respect to the display region 120. Note that the pre-charge circuit 150 is disposed on a side in a direction opposite to the first direction D1 with respect to the display region 120.

The data line drive circuit 210 outputs the image signals S for eight pixels as a time-series serial signals to each of the demultiplexers 140. For example, the data line drive circuit 210 sequentially outputs image signals S[1] to S[8] to the demultiplexer 140[1], and sequentially outputs image signals S[n−7] to S[n] to the demultiplexer 140[*k*]. The image signal S supplied to signal lines 111 in an identical sequence is outputted from the data line drive circuit 210 in parallel to each demultiplexer 140. In other words, the data line drive circuit 210 outputs each image signal S supplied to the signal lines 111 in the identical sequence in parallel to each of the plurality of signal line groups.

Note that polarity inversion driving is adopted in the electro-optical device 1, and thus the polarity of the image signal S output from the data line drive circuit 210 to each demultiplexer 140 is inverted with respect to a predetermined voltage in a predetermined cycle. The inversion of the polarity of the image signal S may be performed by the data line drive circuit 210 or may be performed by a functional block other than the data line drive circuit 210. A method for inverting the polarity of the image signal S with reference to a predetermined voltage in a predetermined cycle is known, and thus description thereof is omitted.

The image signal S output from the data line drive circuit 210 to each demultiplexer 140 is an example of a first image signal, a second image signal, and a third image signal, a polarity of which is inverted with reference to a predetermined voltage in a predetermined cycle. Further, the demultiplexer 140 described above is an example of a signal line drive circuit configured to supply the first image signal to the first signal line in the first writing period, supply the second image signal to the second signal line in the second writing period, and supply the third image signal to the third signal line in the third writing period.

The control circuit 212 synchronizes and controls the scanning line drive circuit 130, the demultiplexer 140, the pre-charge circuit 150, and the like. For example, the control circuit 212 outputs a control signal for controlling an operation of the scanning line drive circuit 130 to the scanning line drive circuit 130, outputs the write selection signal SL to the demultiplexer 140, and outputs the pre-charge control signal PSL to the pre-charge circuit 150.

Note that the control circuit 212 changes one or both of a timing for outputting the pre-charge control signal PSL to the pre-charge circuit 150 and a period in which the pre-charge control signal PSL is maintained at a selected voltage in accordance with a polarity of the image signal S. In other words, the control circuit 212 changes one or both of a start timing of the pre-charge period Tprc and a length of the pre-charge period Tprc in accordance with the polarity of the image signal S. The control circuit 212 is an example of a timing control circuit. Details of the timing for outputting the pre-charge control signal PSL to the pre-charge circuit 150 will be described in FIGS. 4 and 5.

The pre-charge power supply 220 supplies the pre-charge signal PRC of a voltage based on the polarity of the image signal S to the pre-charge power supply line 115. In other words, the voltage of the pre-charge signal PRC varies depending on whether the image signal S is a positive polarity or a negative polarity. For example, the voltage of the pre-charge signal PRC when the image signal S is a negative polarity is a voltage lower than the voltage of the pre-charge signal PRC when the image signal S is a positive polarity.

Note that the configuration of the electro-optical device 1 is not limited to the example illustrated in FIG. 2. For example, one or both of a functional block that outputs a control signal for controlling an operation of the scanning line drive circuit 130 to the scanning line drive circuit 130 and a functional block that outputs the write selection signal SL to the demultiplexer 140 may be provided separately from the control circuit 212.

FIG. 3 is a circuit diagram illustrating the configuration of the pixel 122. Each pixel 122 includes the liquid crystal element 123, a retention capacitor 124, and a pixel transistor 125. The liquid crystal element 123 is an electro-optical element including a pixel electrode 123*a* and a common electrode 123*b* that face each other, and the liquid crystal 123*c* disposed between the pixel electrode 123*a* and the common electrode 123*b*. A display gradation changes due to a change in transmittance of the liquid crystal 123*c* in accordance with an applied voltage between the pixel electrode 123*a* and the common electrode 123*b*. Note that a common voltage Vcom that is a constant voltage is supplied to the common electrode 123*b* via the common line 117.

The retention capacitor 124 is provided in parallel with the liquid crystal element 123. One terminal of the retention capacitor 124 is coupled to the pixel transistor 125, and the other terminal is coupled to the capacitance line 116. Then, the common voltage Vcom is supplied to the other terminal of the retention capacitor 124 via the capacitance line 116.

The pixel transistor 125 is, for example, an N-channel type transistor constituted by a TFT or the like, and is provided between the liquid crystal element 123 and the signal line 111. Then, the pixel transistor 125 is set to either the conductive state or the non-conductive state in accordance with a level of the scanning signal G supplied to the scanning line 110 coupled to a gate. In other words, the pixel transistor 125 controls an electrical coupling between the liquid crystal element 123 and the signal line 111. For example, setting the scanning signal G[p] to the selected voltage allows the pixel transistor 125 in each pixel 122 in the p-th row to transition to the conductive state simultaneously or substantially simultaneously.

When the pixel transistor 125 is controlled to be set to the conductive state, the image signal S supplied from the signal line 111 is applied to the liquid crystal element 123. The liquid crystal 123*c* is set to a transmittance based on the image signal S by being applied with the image signal S. As a result, a gradation of each pixel 122 is set to a gradation specified by the image signal S. For example, when a light source, which is not illustrated, is turned on, light emitted from the light source passes through the liquid crystal 123*c* of the liquid crystal element 123 included in the pixel 122 and is outputted to an outside of the electro-optical device 1. In other words, when the image signal S is applied to the liquid crystal element 123, and the light source is turned on, the pixel 122 displays the gradation based on the image signal S.

In addition, the retention capacitor 124 provided in parallel with the liquid crystal element 123 is charged to a voltage applied to the liquid crystal element 123. In other words, each pixel 122 retains a potential corresponding to the image signal S in the retention capacitor 124.

Then, when the pre-charge signal PRC is supplied to the signal line 111, a change in potential of the signal line 111 may propagate to the capacitance line 116 via a coupling capacitor 118. In this case, when the supply of the image signal S to the signal line 111 ends before a potential fluctuation of the capacitance line 116 due to the pre-charge stabilizes, a potential of the signal line 111 in a period after the time at which the potential fluctuation of the capacitance line 116 stabilizes is deviated from a potential of the signal line 111 at the end of the supply of the image signal S.

Therefore, when the supply of the image signal S to the signal line 111 ends before the potential fluctuation of the capacitance line 116 due to the pre-charge stabilizes, writing accuracy to the pixel 122 decreases and image quality deteriorates. By increasing the time from the end of the pre-charge period Tprc to the end of the writing period Twrt, the time until the potential fluctuation of the capacitance line 116 due to the pre-charge stabilizes can be secured. Thus, in the electro-optical device 1, by changing one or both of the start timing of the pre-charge period Tprc and the length of the pre-charge period Tprc in accordance with the polarity of the image signal S, insufficiency of time until the potential fluctuation of the capacitance line 116 due to the pre-charge stabilizes is suppressed. Next, with reference to FIG. 4, an overview of an operation of the electro-optical device 1 when the start timing of the pre-charge period Tprc and the length of the pre-charge period Tprc are changed in accordance with the polarity of the image signal S will be described.

FIG. 4 is a timing chart illustrating the overview of the operation of the electro-optical device 1. A horizontal scanning period Hp[1] illustrated in FIG. 4 is a horizontal scanning period for writing a video voltage based on the image signal S of a positive polarity to the pixel 122 in a first row. A horizontal scanning period Hn[1] is a horizontal scanning period for writing a video voltage based on the image signal S of a negative polarity to the pixel 122 in the first row. In positive driving, the pre-charge signal PRC having a voltage Vprcp is supplied to the pre-charge power supply line 115. In negative driving, the pre-charge signal PRC having a voltage Vprcn lower than the voltage Vprcp is supplied to the pre-charge power supply line 115.

When the common voltage Vcom supplied to the capacitance line 116 is fixed, a voltage range of the image signal S varies depending on a polarity of the image signal S, and thus a voltage optimum for the pre-charge also varies depending on the polarity of the image signal S. For example, when the common voltage Vcom is 7V, a voltage range of the image signal S in the positive driving is 7V to 12V, a voltage range of the image signal S in the negative driving is 2V to 7V, the voltage Vprcp is 4V, and the voltage Vprcn is 2V. Further, the write selection signal SL and the pre-charge control signal PSL are 15.5V at the high level and 0V at the low level, for example. Note that a voltage value and the like of the common voltage Vcom are not limited to the numerical examples described above. First, operation timings in the horizontal scanning period Hp in the positive driving will be described.

In the horizontal scanning period Hp[1] in the positive driving, a scanning signal G[1] to be supplied to the scan line 110 in the first row is set to the high level. The scanning signal G to be supplied to the scan line 110 in a row other than the first row is maintained at the low level. Each high level period of the write selection signals SL[1] to SL[8] is switched in order of the write selection signals SL[1], SL[3], SL[5], SL[7], SL[2], SL[4], SL[6], and SL[8]. In other words, the writing period Twrt of the image signal S is assigned in order to the signal lines 111 in respective sequences from the signal line 111 in the first sequence to the signal line 111 in the eighth sequence. As a result, the image signal S is sequentially supplied to the signal lines 111 in the respective sequences.

Furthermore, each high level period of the pre-charge control signals PSL[3], PSL[5], PSL[7], PSL[2], PSL[4], PSL[6], and PSL[8] is switched in accordance with the switching of each high level period of the write selection signals SL[1], SL[3], SL[5], SL[7], SL[2], SL[4], and SL[6]. In other words, each high level period of the pre-charge control signals PSL[2] to PSL[8] is switched in the order of the pre-charge control signals PSL[3], PSL[5], PSL[7], PSL[2], PSL[4], PSL[6], and PSL[8]. In the horizontal scanning period Hp[1], the pre-charge control signal PSL[1] is maintained at the low level.

For example, when the image signal S[4], the image signal S[6], and the image signal S[8] are supplied sequentially to the signal line 111 in the fourth sequence, the signal line 111 in the sixth sequence, and the signal line 111 in the eighth sequence, the control circuit 212 starts the pre-charge period Tprc in the eighth sequence until the writing period Twrt in the sixth sequence starts after the writing period Twrt in the fourth sequence ends. Then, the control circuit 212 terminates the pre-charge period Tprc in the eighth sequence within the writing period Twrt in the sixth sequence.

Specifically, the control circuit 212 transitions the pre-charge control signal PSL[8] to the high level in advance of the timing for causing the write selection signal SL[6] to transition to the high level by an advance time tlp, and transitions the pre-charge control signal PSL[8] to the low level after a lapse of a pre-charge time tpp. In other words, in the positive driving, the pre-charge control signal PSL[8] is maintained at a selected voltage only for the pre-charge time tpp. Therefore, the pre-charge time tpp is a length of the pre-charge period Tprc in the positive driving. Note that the pre-charge time tpp having the length of the pre-charge period Tprc is shorter than a time acquired by adding the advance time tlp to the length of the writing period Twrt.

In the electro-optical device 1, the time from the end of the pre-charge period Tprc to the end of the writing period Twrt can be longer by the advance time tlp than that when the start timing of the pre-charge period Tprc is the same as the starting timing of the writing period Twrt. As a result, the electro-optical device 1 can suppress insufficiency of time required until a potential fluctuation of the capacitance line 116 due to the pre-charge stabilizes. Next, operation timings in the horizontal scanning period Hn in the negative driving will be described.

An advance time tln and a pre-charge time tpn at the operation timing in the horizontal scanning period Hn[1] in the negative driving are different from the advance time tlp and the pre-charge time tpp in the positive driving. The other operation timing in the horizontal scanning period Hn[1] in the negative driving is the same as the operation timing in the horizontal scanning period Hp[1] in the positive driving. Thus, the advance time tln and the pre-charge time tpn will be mainly described below.

The control circuit 212 transitions the pre-charge control signal PSL[8] to the high level in advance of the timing for causing the write selection signal SL[6] to transition to the high level by the advance time tln, and transitions the pre-charge control signal PSL[8] to the low level after a lapse of the pre-charge time tpn. Note that the advance time tln in the negative driving is shorter than the advance time tlp in the positive driving. Therefore, in the negative driving, the pre-charge control signal PSL[8] transitions to the high level at a timing later than that in the positive driving. Further, the pre-charge time tpn in the negative driving is shorter than the pre-charge time tpp in the positive driving. Therefore, in the negative driving, a period in which the pre-charge control signal PSL[8] is maintained at a selected voltage is shorter than that in the positive driving.

In other words, in the negative driving, the start timing of the pre-charge period Tprc is later than that in the positive driving, and a length of the pre-charge period Tprc is shorter than that in the positive driving. In the example illustrated in FIG. 4, a length of the writing period Twrt is the same in the positive driving and the negative driving. Also in the negative driving, by setting the pre-charge time tpn having the length of the pre-charge period Tprc to be shorter than the time acquired by adding the advance time tln to the length of the writing period Twrt, insufficiency of time until a potential fluctuation of the capacitance line 116 due to the pre-charge stabilizes can be suppressed. Hereinafter, when the advance times tlp and tln do not need to be distinguished from each other and the like, the advance times tlp and tln are also simply referred to as an advance time tl, and when the pre-charge times tpp and tpn do not need to be distinguished from each other and the like, the pre-charge times tpp and tpn are also simply referred to as a pre-charge time tp.

In the example illustrated in FIG. 4, the control circuit 212 changes both of the start timing of the pre-charge period Tprc and the length of the pre-charge period Tprc in accordance with a polarity of the image signal S by changing both of the advance time tl and the pre-charge time tp in accordance with the polarity of the image signal S. Note that the control circuit 212 may change only the advance time tl of the advance time tl and the pre-charge time tp in accordance with a polarity of the image signal S, or may change only the pre-charge time tp of the advance time tl and the pre-charge time tp in accordance with a polarity of the image signal S. In other words, the control circuit 212 may change only one of the start timing of the pre-charge period Tprc and the length of the pre-charge period Tprc in accordance with a polarity of the image signal S.

Figure 5:
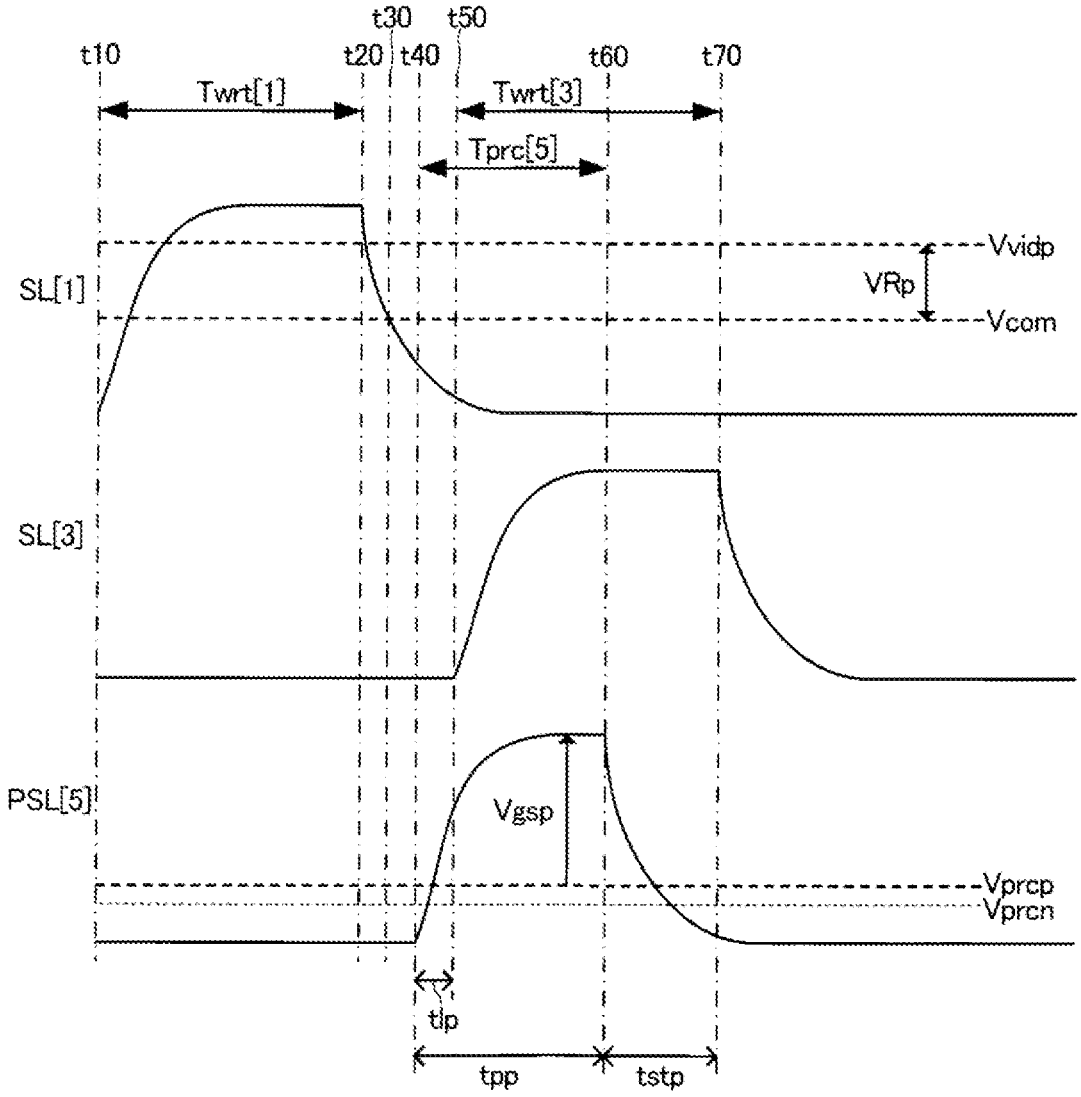
FIG. 5 is a diagram illustrating a timing relationship between a write selection signal and a pre-charge control signal in positive driving.

FIG. 5 is a diagram illustrating a timing relationship between the write selection signal SL and the pre-charge control signal PSL in the positive driving. Note that FIG. 5 illustrates a timing relationship between the write selection signals SL[1] and SL[3] and the pre-charge control signal PSL[5] when the image signals S[1], S[3], and S[5] are respectively supplied to the signal lines 111 in the first sequence, the third sequence, and the fifth sequence in order of the image signals S[1], S[3], and S[5]. In the example illustrated in FIG. 5, the signal line 111 in the first sequence is an example of a first signal line, the signal line 111 in the third sequence is an example of a second signal line, and the signal line 111 in the fifth sequence is an example of a third signal line. Further, in the example illustrated in FIG. 5, the writing period Twrt[1] in the first sequence is an example of a first writing period, the writing period Twrt[3] in the third sequence is an example of a second writing period, and the writing period Twrt[5] in the fifth sequence, which is not illustrated in FIG. 5, is an example of a third writing period. Further, the image signal S supplied to the signal line 111 in the first sequence in the writing period Twrt[1] in the first sequence is an example of a first image signal. The image signal S supplied to the signal line 111 in the third sequence in the writing period Twrt[3] in the third sequence is an example of a second image signal. The image signal S supplied to the signal line 111 in the fifth sequence in the writing period Twrt[5] in the fifth sequence, which is not illustrated in FIG. 5, is an example of a third image signal.

An advance time tlp in FIG. 5 indicates a time from the start of the pre-charge period Tprc[5] in the fifth sequence to the start of the writing period Twrt[3] in the third sequence, and the pre-charge time tpp indicates a time from the start to the end of the pre-charge period Tprc[5] in the fifth sequence. Further, a gate-source voltage Vgsp in FIG. 5 indicates a voltage between a gate and a source of the pre-charge selection transistor 154[5] in the pre-charge period Tprc[5] in the fifth sequence. A voltage Vvidp in FIG. 5 indicates a highest voltage of the image signal S in the positive driving, and a voltage range VRp indicates a voltage range of the image signal S in the positive driving. Note that, in FIG. 5, the timing relationship between the write selection signal SL and the pre-charge control signal PSL is described with a lowest voltage of the image signal S in the positive driving as the common voltage Vcom.

At a time t10, the write selection signal SL[1] transitions to the high level, and the writing period Twrt[1] in the first sequence starts. At a time t20, the write selection signal SL[1] transitions to the low level, and the writing period Twrt[1] in the first sequence ends. In other words, the time t20 is an end timing of the writing period Twrt[1] in the first sequence. Then, at a time t30, a voltage of the write selection signal SL[1] reaches the common voltage Vcom. The voltage of the write selection signal SL[1] reaches the common voltage Vcom, and thus the write selection transistor 142[1] transitions from the conductive state to the non-conductive state. More precisely, the voltage of the write selection signal SL[1] reaches a voltage acquired by adding a threshold voltage of the write selection transistor 142[1] to the common voltage Vcom, and thus the write selection signal 142[1] transitions from the conductive state to the non-conductive state. Hereinafter, for simplification of description, the voltage acquired by the threshold voltage of the write selection transistor 142[1] to the common voltage Vcom is also described as the common voltage Vcom.

At a time t40, the pre-charge control signal PSL[5] transitions to the high level, and the pre-charge period Tprc[5] in the fifth sequence starts. At a time t50, the write selection signal SL[3] transitions to the high level, and the writing period Twrt[3] in the third sequence starts. Then, at a time t60, the pre-charge control signal PSL[5] transitions to the low level, and the pre-charge period Tprc[5] in the fifth sequence ends. In other words, the time t60 is an end timing of the pre-charge period Tprc[5] in the fifth sequence. At a time t70, the write selection signal SL[3] transitions to the low level, and the writing period Twrt[3] in the third sequence ends. As described above, the writing period Twrt[3] in the third sequence and the pre-charge period Tprc[5] in the fifth sequence partially overlap each other.

As illustrated in FIG. 5, in the positive driving, by setting the time t40 between the time t30 and the time t50 to the start timing of the pre-charge period Tprc[5] in the fifth sequence, the pre-charge period Tprc[5] in the fifth sequence can be started in advance of the start of the writing period Twrt[3] in the third sequence. As a result, a stabilization time tstp, which is a time from the end of the pre-charge period Tprc[5] in the fifth sequence to the end of the writing period Twrt[3] in the third sequence, can be longer than that when the start of the pre-charge period Tprc[5] in the fifth sequence does not precede the start of the writing period Twrt[3] in the third sequence. With a longer stabilization time tstp, a video voltage based on the image signal S can be more accurately written to the pixel 122, and image quality can be further improved.

Note that, when a time before the time t30 is set to the start timing of the pre-charge period Tprc[5] in the fifth sequence, since the write selection transistor 142[1] is in the conductive state, writing accuracy of the image signal S to the signal line 111 in the first sequence is decreased by an influence of noise of the capacitance line 116 generated due to the start of the pre-charge of the signal line 111 in the fifth sequence.

Further, when a time after the time t50 is set to the start timing of the pre-charge period Tprc[5] in the fifth sequence, a length of the pre-charge period Tprc[5] in the fifth sequence is shortened in order to secure the stabilization time tstp, and writing accuracy of the pre-charge signal PRC to the signal line 111 in the fifth sequence decreases.

By setting the time t40 between the time t30 and the time t50 to the start timing of the pre-charge period Tprc[5] in the fifth sequence, the electro-optical device 1 can suppress a decrease in the writing accuracy of the image signal S to the signal line 111 in the first sequence and the writing accuracy of the pre-charge signal PRC to the signal line 111 in the fifth sequence.

Figure 6:
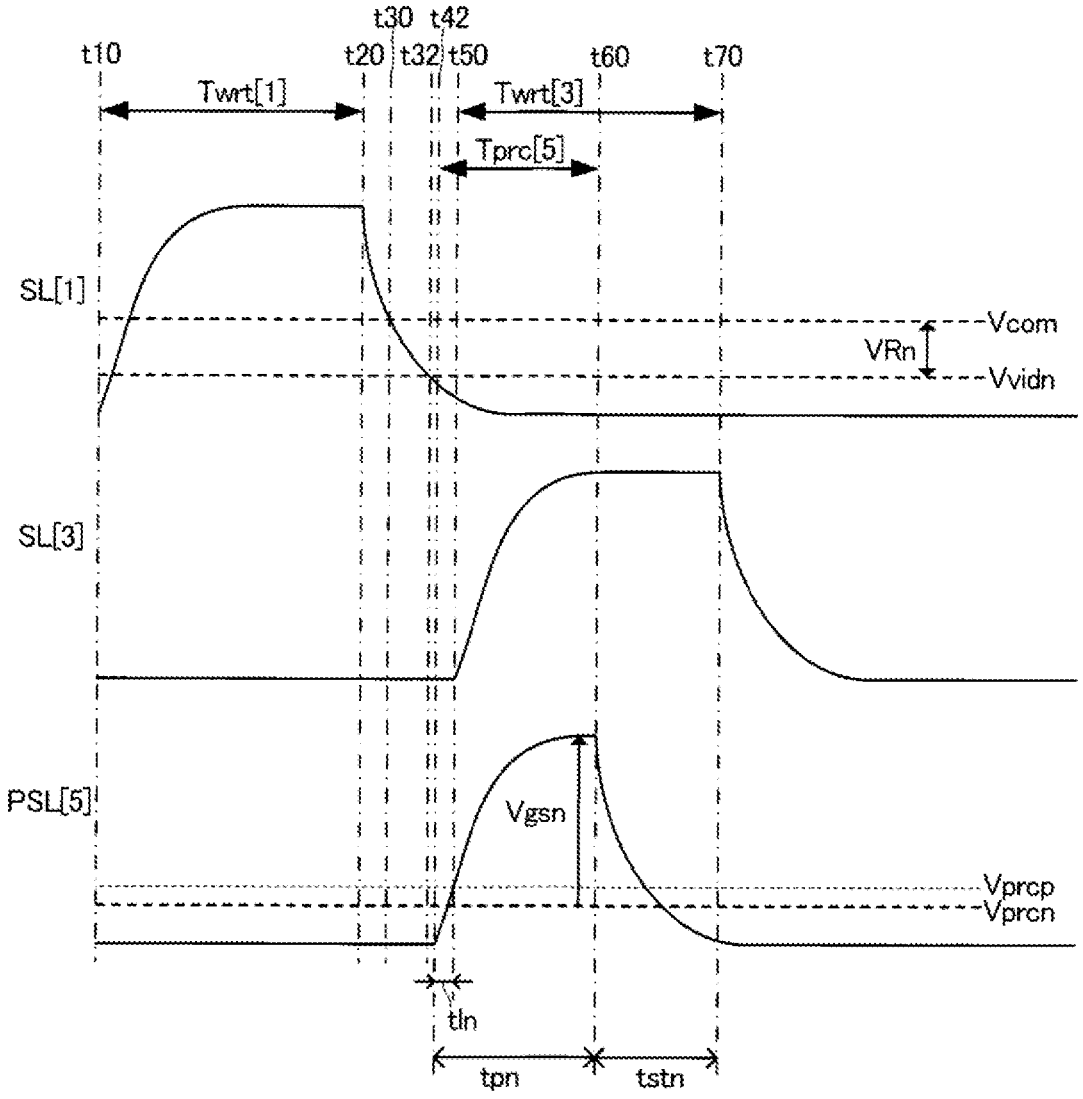
FIG. 6 is a diagram illustrating a timing relationship between the write selection signal and the pre-charge control signal in negative driving.

FIG. 6 is a diagram illustrating a timing relationship between the write selection signal SL and the pre-charge control signal PSL in the negative driving. Note that FIG. 6 illustrates a timing relationship between the write selection signals SL[1] and SL[3] and the pre-charge control signal PSL[5] in the same order in which the image signal S is supplied to the signal lines 111 as that in FIG. 5. Detailed description of an operation similar to the operation described in FIG. 5 will be omitted. Also in the example illustrated in FIG. 6, the signal line 111 in the first sequence is an example of a first signal line, the signal line 111 in the third sequence is an example of a second signal line, and the signal line 111 in the fifth sequence is an example of a third signal line. Further, also in the example illustrated in FIG. 6, the writing period Twrt[1] in the first sequence is an example of a first writing period, the writing period Twrt[3] in the third sequence is an example of a second writing period, and the writing period Twrt[5] in the fifth sequence, which is not illustrated in FIG. 6, is an example of a third writing period. Further, the image signal S supplied to the signal line 111 in the first sequence in the writing period Twrt[1] in the first sequence is an example of a first image signal. The image signal S supplied to the signal line 111 in the third sequence in the writing period Twrt[3] in the third sequence is an example of a second image signal. The image signal S supplied to the signal line 111 in the fifth sequence in the writing period Twrt[5] in the fifth sequence, which is not illustrated in FIG. 6, is an example of a third image signal.

The advance time tln in FIG. 6 indicates a time from the start of the pre-charge period Tprc[5] in the fifth sequence to the start of the writing period Twrt[3] in the third sequence, and the pre-charge time tpn indicates a time from the start to the end of the pre-charge period Tprc[5] in the fifth sequence. Further, a gate-source voltage Vgsn in FIG. 6 indicates a voltage between a gate and a source of the pre-charge selection transistor 154[5] in the pre-charge period Tprc[5] in the fifth sequence. A voltage Vvidn in FIG. 6 indicates a lowest voltage of the image signal S in the negative driving, and a voltage range VRn indicates a voltage range of the image signal S in the negative driving. Note that, in FIG. 6, the timing relationship between the write selection signal SL and the pre-charge control signal PSL is described with a highest voltage of the image signal S in the negative driving as the common voltage Vcom.

At a time t10, the write selection signal SL[1] transitions to the high level, and the writing period Twrt[1] in the first sequence starts. At a time t20, the write selection signal SL[1] transitions to the low level, and the writing period Twrt[1] in the first sequence ends. Then, at a time t32, a voltage of the write selection signal SL[1] reaches the voltage Vvidn. The voltage of the write selection signal SL[1] reaches the voltage Vvidn, and thus the write selection transistor 142[1] transitions from the conductive state to the non-conductive state. More precisely, the voltage of the write selection signal SL[1] reaches a voltage acquired by adding a threshold voltage of the write selection transistor 142[1] to the voltage Vvidn, and thus the write selection signal 142[1] transitions from the conductive state to the non-conductive state. Hereinafter, for simplification of description, the voltage acquired by the threshold voltage of the write selection transistor 142[1] to the voltage Vvidn is also described as the voltage Vvidn.

At a time t42, the pre-charge control signal PSL[5] transitions to the high level, and the pre-charge period Tprc[5] in the fifth sequence starts. At a time 50, the write selection signal SL[3] transitions to the high level, and the writing period Twrt[3] in the third sequence starts. Then, at a time t60, the pre-charge control signal PSL[5] transitions to the low level, and the pre-charge period Tprc[5] in the fifth sequence ends. At a time t70, the write selection signal SL[3] transitions to the low level, and the writing period Twrt[3] in the third sequence ends.

Also in the negative driving, by setting the time t42 between the time t32 and the time t50 to the start timing of the pre-charge period Tprc[5] in the fifth sequence, the electro-optical device 1 can suppress a decrease in the writing accuracy of the image signal S to the signal line 111 in the first sequence and the writing accuracy of the pre-charge signal PRC to the signal line 111 in the fifth sequence. Note that, in the negative driving, for example, even when the pre-charge period Tprc[5] in the fifth sequence starts after the start of the writing period Twrt[3] in the third sequence, the stabilization time tstp can be secured by shortening a length of the pre-charge period Tprc[5] in the fifth sequence. In this case, the control circuit 212 may start the pre-charge period Tprc[5] in the fifth sequence after the start of a writing period Twrt in a sixth sequence. Hereinafter, the stabilization times tstp and tstn are also simply referred to as a stabilization time tst when the stabilization times tstp and tstn do not need to be distinguished from each other and the like.

Here, when comparing the positive driving in FIG. 5 with the negative driving in FIG. 6, the common voltage Vcom, which is the lowest voltage of the image signal S in the positive driving, is higher than the voltage Vvidn, which is the lowest voltage of the image signal S in the negative driving. Thus, a time required for the write selection signal SL[1] at the high level to reach the lowest voltage of the image signal S from a selected state voltage is shorter in the positive driving than that in the negative driving. Therefore, in the electro-optical device 1, the advance time tlp in the positive driving can be longer than the advance time tln in the negative driving. Specifically, when a polarity of the image signal S is a positive polarity, the control circuit 212 advances the start timing of the pre-charge period Tprc as compared to a case when a polarity of the image signal S is a negative polarity.

Note that, for example, in the negative driving, when a time between the time t30 and the time t32 is set to the start timing of the pre-charge period Tprc[5] in the fifth sequence, and then the voltage Vvidn lower than the common voltage Vcom is supplied to the signal line 111 in the first sequence, the write selection transistor 142[1] is in the conductive state. In this case, writing accuracy of the image signal S to the signal line 111 in the first sequence is decreased by an influence of noise of the capacitance line 116 generated due to the start of the pre-charge of the signal line 111 in the fifth sequence. Note that, in order to facilitate comparison between the positive driving in FIG. 5 and the negative driving in FIG. 6, a time at which the voltage of the write selection signal SL[1] reaches the common voltage Vcom is the time t30 in FIG. 6, but a time required until the write selection signal SL[1] at the high level reaches the common voltage Vcom is not necessarily the same in the positive driving and the negative driving.

In the electro-optical device 1, the start timing of the pre-charge period Tprc in the positive driving is earlier than the start timing of the pre-charge period Tprc in the negative driving, and thus the pre-charge time tpp in the positive driving can be longer than the pre-charge time tpn in the negative driving as compared to a case when the start timing of the pre-charge period Tprc is common in the positive driving and the negative driving. As a result, variations in writing accuracy of the pre-charge signal PRC in the positive driving and writing accuracy of the pre-charge signal PRC in the negative driving can be suppressed as compared to a case when the start timing of the pre-charge period Tprc is common in the positive driving and the negative driving.

Further, the start timing of the pre-charge period Tprc in the positive driving is earlier than the start timing of the pre-charge period Tprc in the negative driving, and thus the stabilization time tstp in the positive driving can be longer than that when the start timing of the pre-charge period Tprc is common in the positive driving and the negative driving. As a result, a decrease in writing accuracy of the image signal S in the positive driving can be suppressed as compared to a case when the start timing of the pre-charge period Tprc is common in the positive driving and the negative driving.

Furthermore, when comparing the positive driving in FIG. 5 with the negative driving in FIG. 6, the voltage Vprcp is higher than the voltage Vprcn, and thus the gate-source voltage Vgsp in the positive driving is smaller than the gate-source voltage Vgsn in the negative driving. In other words, the gate-source voltage Vgsn in the negative driving is greater than the gate-source voltage Vgsp in the positive driving. Thus, capability of the pre-charge selection transistor 154 to drive the signal line 111 is greater in the negative driving than that in the positive driving. Therefore, in the electro-optical device 1, the pre-charge time tpn in the negative driving can be shorter than the pre-charge time tpp in the positive driving. Specifically, when a polarity of the image signal S is a negative polarity, the control circuit 212 shortens a length of the pre-charge period Tprc as compared to a case when a polarity of the image signal S is a positive polarity. In other words, a length of the pre-charge period Tprc in the positive driving is longer than a length of the pre-charge period Tprc in the negative driving. As a result, variations in writing accuracy of the pre-charge signal PRC in the positive driving and writing accuracy of the pre-charge signal PRC in the negative driving can be suppressed as compared to a case when a length of the pre-charge period Tprc is common in the positive driving and the negative driving.

Further, in the negative driving, the stabilization time tstn can be longer by shortening a length of the pre-charge period Tprc.

In other words, in the electro-optical device 1, a length of the pre-charge period Tprc in the negative driving is shorter than a length of the pre-charge period Tprc in the positive driving, and thus the stabilization time tstn in the negative driving can be longer than that when a length of the pre-charge period Tprc is common in the positive driving and the negative driving. In other words, a length of the pre-charge period Tprc in the positive driving is longer than a length of the pre-charge period Tprc in the negative driving. As a result, variations in writing accuracy of the pre-charge signal PRC in the positive driving and writing accuracy of the pre-charge signal PRC in the negative driving can be suppressed as compared to a case when a length of the pre-charge period Tprc is common in the positive driving and the negative driving.

Further, as a result, a decrease in writing accuracy of the image signal S in the negative driving can be suppressed as compared to a case when a length of the pre-charge period Tprc is common in the positive driving and the negative driving. Note that, in FIG. 6, in order to facilitate comparison between the positive polarity driving in FIG. 5 and the negative driving in FIG. 6, a time at which the pre-charge period Tprc[5] in the fifth sequence ends is the time t60, and the stabilization time tstn in the negative driving is the same as the stabilization time tstp in the positive driving, but the stabilization time tstn in the negative driving may be a time different from the stabilization time tstp in the positive driving.

Figure 7:
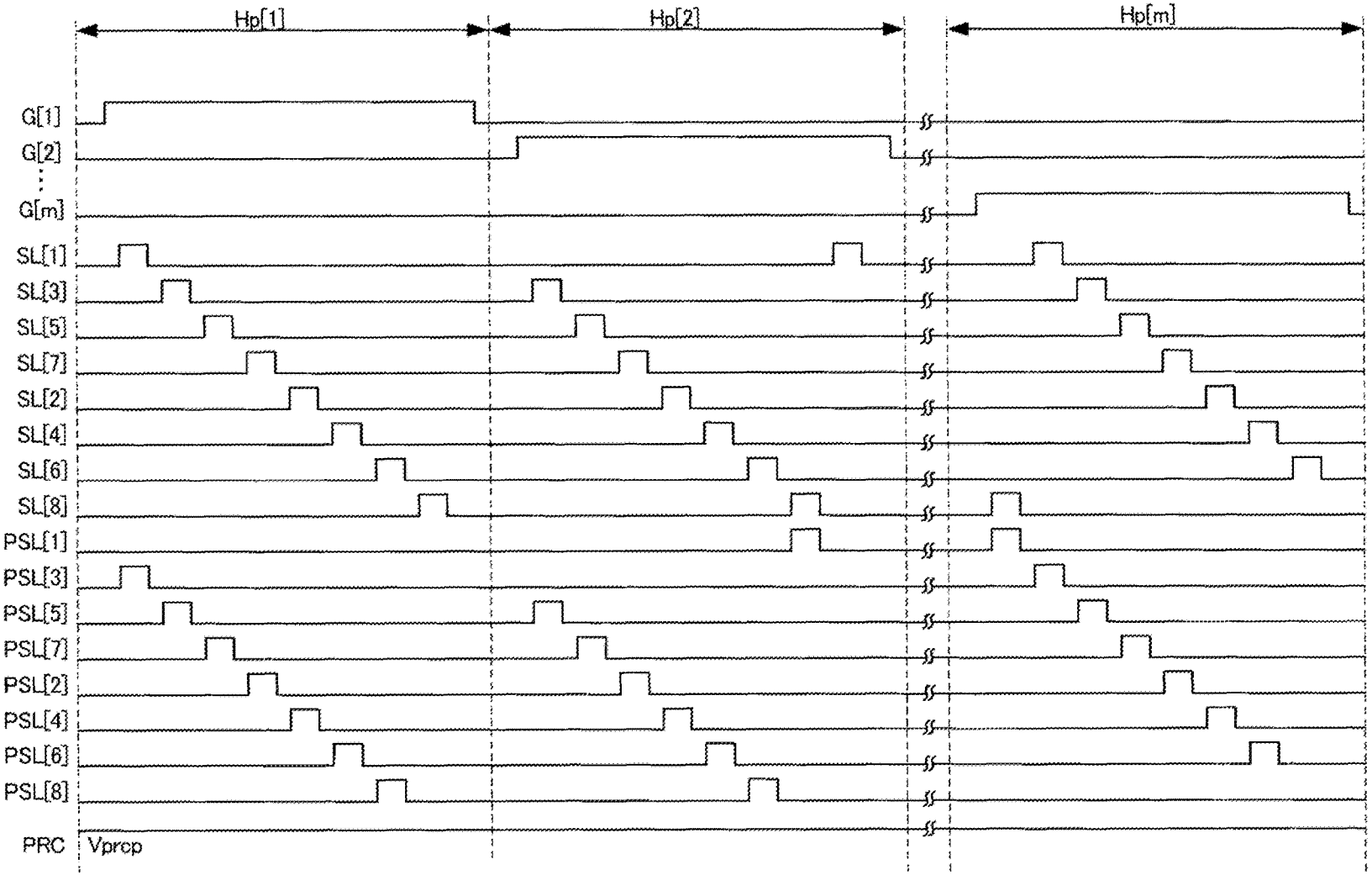
FIG. 7 is a diagram illustrating an example of operation timings of the electro-optical device.

FIG. 7 is a diagram illustrating an example of operation timings of the electro-optical device 1. Note that FIG. 7 illustrates operation timings in horizontal scanning periods Hp[1], Hp[2], and Hp[m] in the positive driving. An advance time tlp and a pre-charge time tpp in each horizontal scanning period Hp are the same as the advance time tlp and the pre-charge time tpp in FIG. 5, and thus descriptions thereof will be omitted. Further, the horizontal scanning period Hp[1] is described in FIG. 4, and thus detailed description thereof will be omitted.

In the horizontal scanning period Hp[1], the scanning signal G[1] supplied to the scanning line 110 in the first row is set at the high level, and the scanning signal G supplied to the scanning line 110 other than the first row is maintained at the low level. Each high level period of the write selection signals SL[1] to SL[8] is switched in order of the write selection signals SL[1], SL[3], SL[5], SL[7], SL[2], SL[4], SL[6], and SL[8]. Furthermore, each high level period of the pre-charge control signals PSL[3], PSL[5], PSL[7], PSL[2], PSL[4], PSL[6], and PSL[8] is switched in accordance with the switching of each high level period of the write selection signals SL[1], SL[3], SL[5], SL[7], SL[2], SL[4], and SL[6]. Note that the pre-charge control signal PSL[1] is maintained at the low level in the horizontal scanning period Hp[1].

In the horizontal scanning period Hp[2], the scanning signal G[2] supplied to the scanning line 110 in the second row is set at the high level, and the scanning signal G supplied to the scanning line 110 other than the second row is maintained at the low level. The horizontal scanning period Hp[2] is different from the horizontal scanning period Hp[1] in the order when the image signal S is supplied sequentially to the signal line 111 of each sequence from the first sequence to the eighth sequence. For example, each high level period of the write selection signals SL[1] to SL[8] is switched in order of the write selection signals SL[3], SL[5], SL[7], SL[2], SL[4], SL[6], SL[8], and SL[1]. Furthermore, each high level period of the pre-charge control signals PSL[5], PSL[7], PSL[2], PSL[4], PSL[6], PSL[8], and PSL[1] is switched in accordance with the switching of each high level period of the write selection signals SL[3], SL[5], SL[7], SL[2], SL[4], SL[6], and SL[8]. Note that the pre-charge control signal PSL[3] is maintained at the low level in the horizontal scanning period Hp[2].

In the horizontal scanning period Hp[m], the scanning signal G[m] supplied to the scanning line 110 in an m-th row is set at the high level, and the scanning signal G supplied to the scanning line 110 other than the m-th row is maintained at the low level. In the example illustrated in FIG. 7, m is a multiple of 8. The horizontal scanning period Hp[m] is different from the horizontal scanning period Hp[1] in the order when the image signal S is supplied sequentially to the signal line 111 in each sequence from the first sequence to the eighth sequence. For example, each high level period of the write selection signals SL[1] to SL[8] is switched in order of the write selection signals SL[8], SL[1], SL[3], SL[5], SL[7], SL[2], SL[4], and SL[6]. Furthermore, each high level period of the pre-charge control signals PSL[1], PSL[3], PSL[5], PSL[7], PSL[2], PSL[4], and PSL[6] is switched in accordance with the switching of each high level period of the write selection signals SL[8], SL[1], SL[3], SL[5], SL[7], SL[2], and SL[4]. Note that the pre-charge selection signal PSL[8] is maintained at the low level in the horizontal scanning period Hp[m].

In the example illustrated in FIG. 7, a sequence of the signal lines 111 on which the pre-charge is not performed is changed for each horizontal scanning period Hp, and is cycled for eight horizontal scanning periods Hp. In the electro-optical device 1, by rotating the sequence of the signal lines 111 on which pre-charge is not performed, the number of times of the pre-charge to the signal lines 111 in each sequence can be made uniform, and thus a decrease in image quality can be suppressed.

Note that the operation timings of the electro-optical device 1 are not limited to the example illustrated in FIG. 7. For example, the order in which the image signal S is supplied to the signal line 111 in each sequence may be an order different from the order illustrated in FIG. 7.

Figure 8:
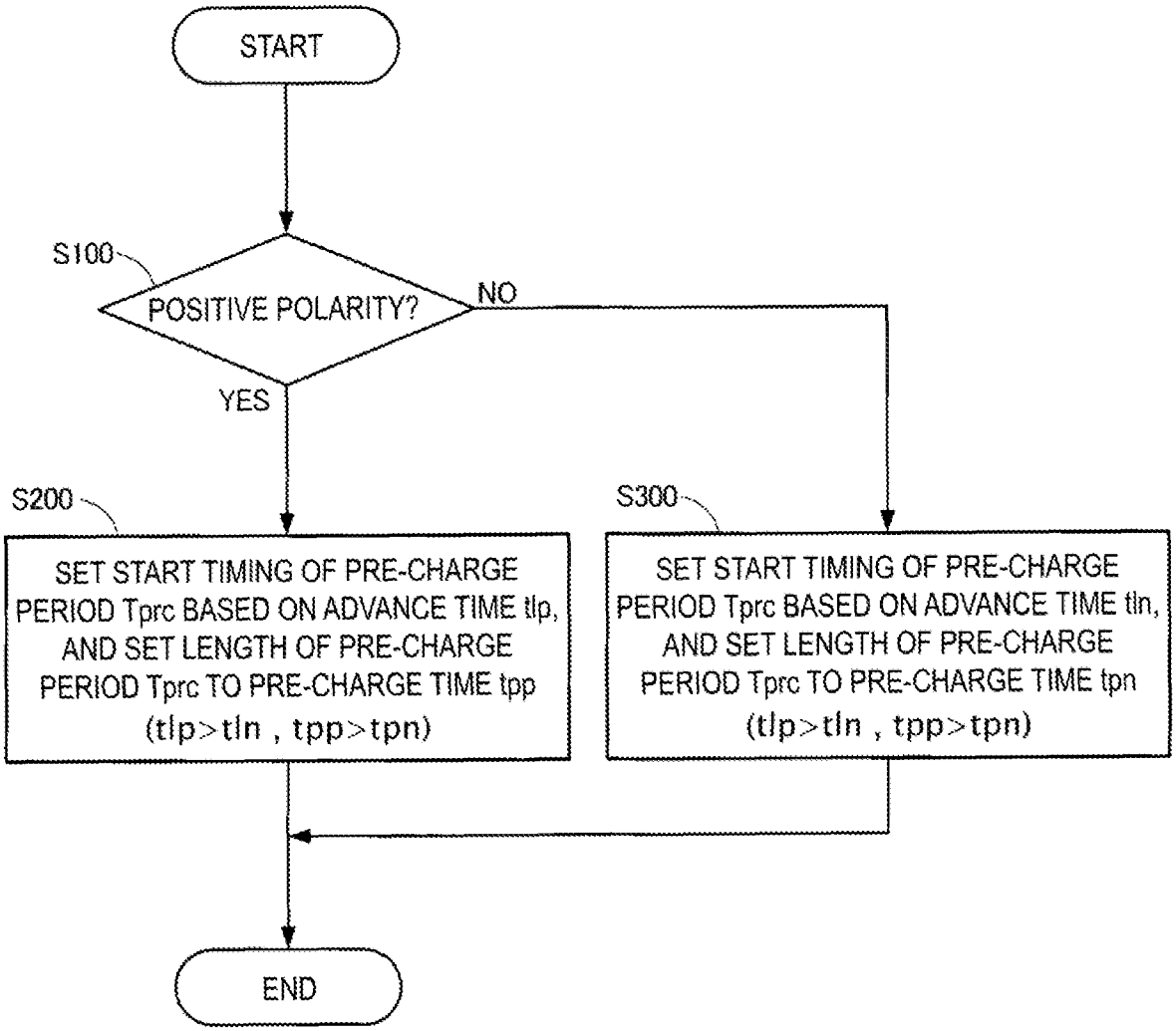
FIG. 8 is a flowchart illustrating an example of an operation of the electro-optical device.

FIG. 8 is a flowchart illustrating an example of an operation of the electro-optical device 1. Note that the operation illustrated in FIG. 8 represents an example of a driving method of the electro-optical device 1. For example, the operation illustrated in FIG. 8 is performed when a polarity of the image signal S switches.

First, in Step S100, the control circuit 212 determines whether or not a polarity of the image signal S is a positive polarity. When the polarity of the image signal S is a positive polarity, the operation of the control circuit 212 proceeds to Step S200. On the other hand, when the polarity of the image signal S is a negative polarity, the operation of the control circuit 212 proceeds to Step S300.

In Step S200, the control circuit 212 sets a start timing of the pre-charge period Tprc based on the advance time tlp in the positive driving, and sets a length of the pre-charge period Tprc to the pre-charge time tpp in the positive driving. Specifically, the control circuit 212 sets an operation timing of the pre-charge control signal PSL such that the pre-charge control signal PSL transitions to the high level in advance of a timing at which the write selection signal SL transitions to the high level by the advance time tlp. As a result, the start timing of the pre-charge period Tprc is set. Further, the control circuit 212 sets an operation timing of the pre-charge control signal PSL such that the pre-charge control signal PSL transitions to the low level after a lapse of the pre-charge time tpp since the pre-charge control signal PSL has transitioned to the high level. As a result, the length of the pre-charge period Tprc is set. Note that the advance time tlp and the pre-charge time tpp are predetermined.

In Step S300, the control circuit 212 sets a start timing of the pre-charge period Tprc based on the advance time tln in the negative driving, and sets a length of the pre-charge period Tprc to the pre-charge time tpn in the negative driving. Note that the advance time tln and the pre-charge time tpn are predetermined. The advance time tlp is a time longer than the advance time tln, and the pre-charge time tpn is a time shorter than the pre-charge time tpp.

Note that the operation of the electro-optical device 1 is not limited to the example illustrated in FIG. 8. For example, the control circuit 212 may set a length of the pre-charge period Tprc to be common in the positive driving and the negative driving, and may change a start timing of the pre-charge period Tprc in accordance with a polarity of the image signal S. Alternatively, the control circuit 212 may set a start timing of the pre-charge period Tprc to be common in the positive driving and the negative driving, and may change a length of the pre-charge period Tprc in accordance with a polarity of the image signal S.

As described above, in the first exemplary embodiment, the electro-optical device 1 includes the control circuit 212 that changes a start timing of the pre-charge period Tprc in accordance with a polarity of the image signal S. When the polarity of the image signal S is a positive polarity, the control circuit 212 advances the start timing of the pre-charge period Tprc as compared to a case when the polarity of the image signal S is a negative polarity. In this case, the pre-charge time tpp in the positive driving can be longer than the pre-charge time tpn in the negative driving as compared to a case when the start timing of the pre-charge period Tprc is common in the positive driving and the negative driving. As a result, variations in writing accuracy of the pre-charge signal PRC in the positive driving and writing accuracy of the pre-charge signal PRC in the negative driving can be suppressed as compared to a case when the start timing of the pre-charge period Tprc is common in the positive driving and the negative driving. Further, the start timing of the pre-charge period Tprc in the positive driving is earlier than the start timing of the pre-charge period Tprc in the negative driving, and thus the stabilization time tstp in the positive driving can be longer than that when the start timing of the pre-charge period Tprc is common in the positive driving and the negative driving. As a result, a decrease in writing accuracy of the image signal S in the positive driving can be suppressed.

Further, the control circuit 212 changes a length of the pre-charge period Tprc in accordance with a polarity of the image signal S. Specifically, when the polarity of the image signal S is a negative polarity, the control circuit 212 shortens a length of the pre-charge period Tprc as compared to a case when the polarity of the image signal S is positive. In other words, a length of the pre-charge period Tprc in the positive driving is longer than a length of the pre-charge period Tprc in the negative driving. As a result, variations in writing accuracy of the pre-charge signal PRC in the positive driving and writing accuracy of the pre-charge signal PRC in the negative driving can be suppressed as compared to a case when a length of the pre-charge period Tprc is common in the positive driving and the negative driving. Further, in this case, the stabilization time tstn in the negative driving can be longer than that when the length of the pre-charge period Tprc is common in the positive driving and the negative driving. As a result, a decrease in writing accuracy of the image signal S in the negative driving can be suppressed.

Modification Example

The first exemplary embodiment can be variously modified. Specific modification modes are exemplified below. Two or more modes freely selected from exemplifications below can be appropriately used in combination as long as mutual contradiction does not arise.

Modification Example 1

Figure 9:
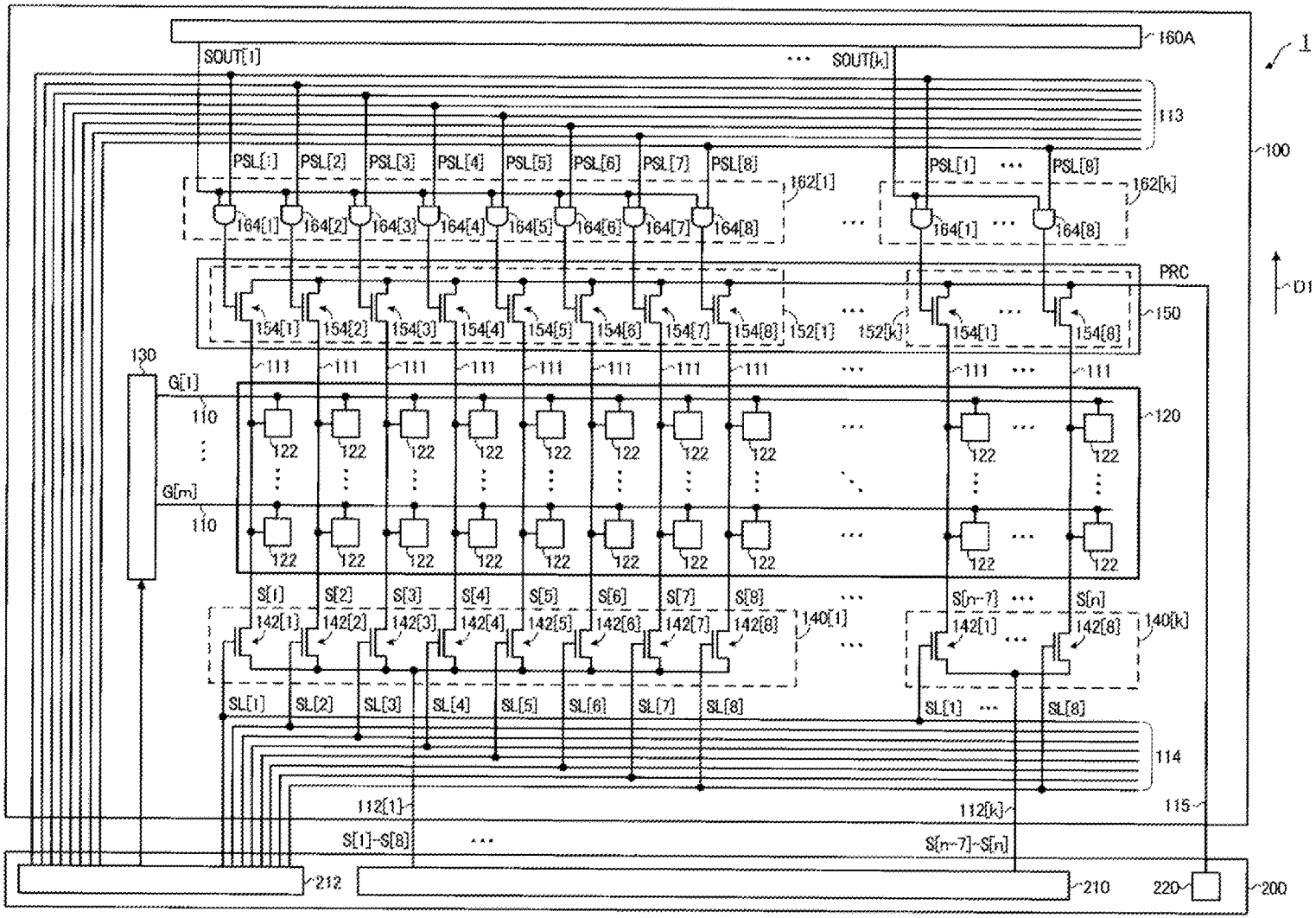
FIG. 9 is a block diagram illustrating a configuration of the electro-optical device in Modification Example 1.

In the first exemplary embodiment, as illustrated in FIG. 9, the pre-charge circuit 150 may be disposed on a side in the first direction D1 with respect to the display region 120.

FIG. 9 is a block diagram illustrating a configuration of the electro-optical device 1 in Modification Example 1. The same elements as the elements already described in FIGS. 1 to 8 have the same reference numerals, and detailed descriptions thereof will be omitted. A meaning of the first direction D1 in FIG. 9 is identical to that of the first direction D1 in FIG. 2.

The electro-optical device 1 illustrated in FIG. 9 is the same as the electro-optical device 1 in FIG. 1, except for the arrangement of the pre-charge circuit 150 in the electro-optical panel 100 and the like. For example, the electro-optical device 1 includes the electro-optical panel 100, the drive integrated circuit 200, and the flexible printed wired board 300 in FIG. 1. The drive integrated circuit 200 is the same as the drive integrated circuit 200 in FIG. 2.

The electro-optical panel 100 illustrated in FIG. 9 includes an inspection circuit 160A instead of the inspection circuit 160 in FIG. 2. Furthermore, a logic circuit 162 is added to the electro-optical panel 100 in FIG. 2. Further, the pre-charge circuit 150 is disposed between the display region 120 and the inspection circuit 160A. The other configuration of the electro-optical panel 100 in FIG. 9 is the same as the electro-optical panel 100 in FIG. 2.

For example, the electro-optical panel 100 includes the display region 120, the scanning line drive circuit 130, the k demultiplexers 140[1] to 140[*k*], the pre-charge circuit 150, the inspection circuit 160A, and the k logic circuits 162[1] to 140[*k*]. Further, the electro-optical panel 100 includes the m scanning lines 110, the n signal lines 111, the k data lines 112, the pre-charge control signal line 113, the write selection signal line 114, the pre-charge power supply line 115, the capacitance line 116 and the common line 117 illustrated in FIG. 3, and the like. Note that, in FIG. 9, description of the capacitance line 116 and the common line 117 is omitted for ease of illustration, similarly to FIG. 2. The inspection circuit 160A and the k logic circuits 162[1] to 140[*k*] different from the electro-optical panel 100 in FIG. 2 will be mainly described below.

The inspection circuit 160A is, for example, a shift register, and outputs an inspection control signal SOUT that indicates a signal line group including the signal line 111 to be inspected to the logic circuit 162. For example, when the signal line 111 coupled to the pre-charge selection transistor 154 of the pre-charge selection circuit 152[*i*] is selected as an inspection target, the inspection circuit 160A outputs the inspection control signal SOUT[i] at a high level to the logic circuit 162[*i*]. When the signal line 111 coupled to the pre-charge selection transistor 154 of the pre-charge selection circuit 152[*i*] is not selected as an inspection target, the inspection circuit 160A outputs the inspection control signal SOUT[i] at a low level to the logic circuit 162[*i*]. Note that, in the normal operation, the inspection control signals SOUT[1] to SOUT[k] are maintained at the high level.

Each logic circuit 162 includes eight AND circuits 164[1] to 164[8]. The AND circuit 164 is provided corresponding to the pre-charge selection transistor 154. Each AND circuit 164 outputs an arithmetic operation result of a logical product of signals received at respective two input terminals. For example, one terminal of the two input terminals of the AND circuit 164[*j*] of the logical circuit 162[*i*] is coupled to the pre-charge control signal line 113 in a j-th sequence, and the inspection control signal SOUT[i] is supplied to the other terminal. Further, an output terminal of the AND circuit 164[*j*] of the logic circuit 162[*i*] is coupled to a gate of the pre-charge selection transistor 154[*j*] of the pre-charge selection circuit 152[*i*].

In other words, the logic circuit 162[*i*] outputs signals generated by each logical product between each of the pre-charge control signals PSL[1] to PSL[8] and the inspection control signal SOUT[i] to the pre-charge selection transistors 154[1] to 154[8] of the pre-charge selection circuit 152[*i*], respectively.

In the inspection operation for inspecting the signal line 111, when the inspection control signal SOUT[i] is at the high level, the AND circuit 164[*j*] of the logic circuit 162[*i*] outputs a pre-charge control signal PSL[j] to the gate of the pre-charge selection transistor 154[*j*] of the pre-charge selection circuit 152[*i*].

Further, when the inspection control signal SOUT[i] is at the low level, the AND circuit 164[*j*] of the logic circuit 162[*i*] outputs a signal at the low level to the gate of the pre-charge selection transistor 154[*j*] of the pre-charge selection circuit 152[*i*]. In other words, when the inspection control signal SOUT[i] is at the low level, the logic circuit 162[*i*] outputs a signal for setting the pre-charge selection transistor 154 to the non-conductive state to the pre-charge selection transistors 154[1] to 154[8] of the pre-charge selection circuit 152[*i*].

In the normal operation, the inspection control signals SOUT[1] to SOUT[k] are maintained at the high level, and thus the AND circuit 164[*j*] of the logic circuit 162[*i*] outputs the pre-charge control signal PSL[j] to the gate of the pre-charge selection transistor 154[*j*] of the pre-charge selection circuit 152[*i*].

Note that the configuration of the electro-optical device 1 in Modification Example 1 is not limited to the example illustrated in FIG. 9. For example, each logic circuit 162 may include an OR circuit instead of the AND circuit 164. In this case, the inspection control signals SOUT[1] to SOUT[k] are maintained at the low level in the normal operation. Further, in a configuration in which an OR circuit is provided instead of the AND circuit 164, for example, the inspection control signal SOUT[i] at the high level indicates that the signal line 111 coupled to the pre-charge selection transistor 154 of the pre-charge selection circuit 152[*i*] is not selected as an inspection target in the inspection operation.

Modification Example 2

In the first exemplary embodiment and Modification Example 1, the n signal lines 111 may not need to be classified into k signal line groups.

Modification Example 3

In the first exemplary embodiment, Modification Example 1, and Modification Example 2, the electro-optical panel 100 may be a reflection-type electro-optical device. Further, when the electro-optical panel 100 is a reflection type, the electro-optical panel 100 may be an LCOS (Liquid Crystal on Silicon) type using a semiconductor substrate for an element substrate on which the signal line 111 and the like are formed.

Application Examples

Figure 10:
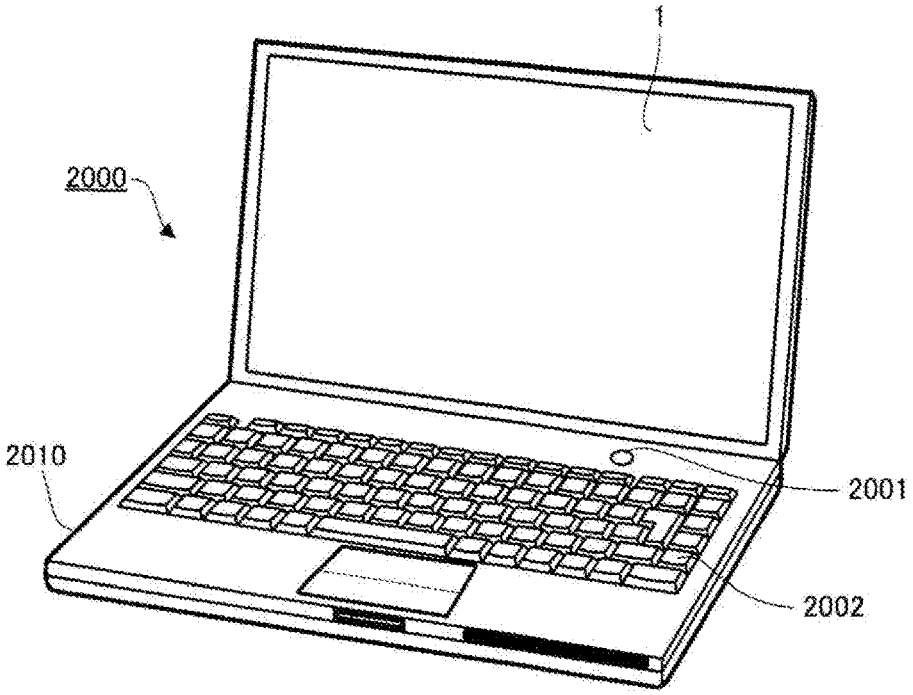
FIG. 10 is a perspective view illustrating a personal computer as an example of an electronic apparatus.
Figure 11:
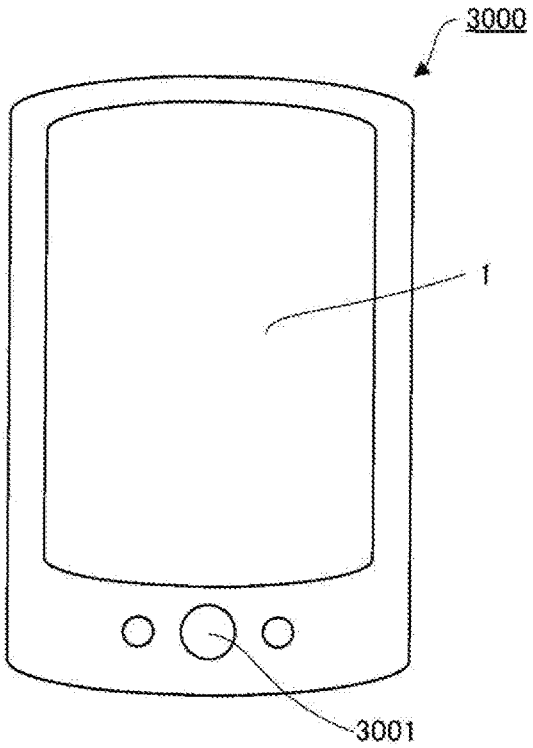
FIG. 11 is a front view illustrating a smartphone as an example of an electronic apparatus.
Figure 12:
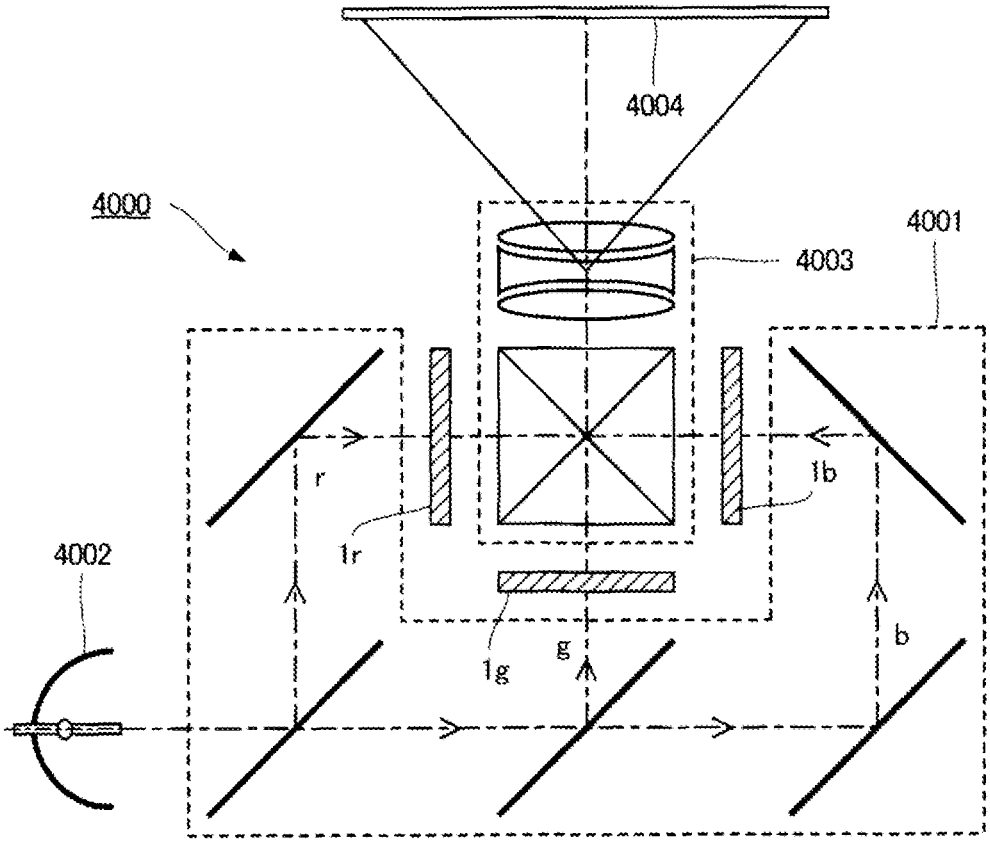
FIG. 12 is a schematic diagram illustrating a projection-type display apparatus as an example of an electronic apparatus.

The present disclosure can be used in various electronic apparatuses. FIG. 10 to FIG. 12 exemplify specific modes of electronic apparatuses to which the present disclosure is applied.

FIG. 10 is a perspective view illustrating a personal computer 2000 as an example of an electronic apparatus. The personal computer 2000 includes the electro-optical device 1 configured to display various images, and a main body portion 2010 in which a power source switch 2001 and a keyboard 2002 are installed.

FIG. 11 is a front view illustrating a smartphone 3000 as an example of an electronic apparatus. The smartphone 3000 includes an operation button 3001 and the electro-optical device 1 configured to display various images. A screen content displayed on the electro-optical device 1 is changed in accordance with an operation of the operation button 3001.

FIG. 12 is a schematic diagram illustrating a projection-type display apparatus 4000 as example of an electronic apparatus. The projection-type display device 4000 is a three-plate type projector, for example. An electro-optical device 1*r* illustrated in FIG. 12 is an electro-optical device 1 corresponding to a red display color, an electro-optical device 1*g* is an electro-optical device 1 corresponding to a green display color, and an electro-optical device 1*b* is an electro-optical device 1 corresponding to a blue display color.

Specifically, the projection-type display apparatus 4000 includes three electro-optical devices 1*r*, 1*g*, and 1*b* that respectively correspond to display colors of red, green, and blue. An illumination optical system 4001 supplies a red component r of light emitted from an illumination device 4002 as a light source to the electro-optical device 1*r*, a green component g of the light to the electro-optical device 1*g*, and a blue component b of the light to the electro-optical device 1*b*. Each of the electro-optical devices 1*r*, 1*g*, and 1*b* functions as an optical modulator, such as a light bulb, that modulates respective rays of the monochromatic light supplied from the illumination optical system 4001 depending on display images. A projection optical system 4003 combines the rays of the light emitted from each of the electro-optical devices 1*r*, 1*g*, and 1*b* to project the combined light to a projection surface 4004.

Each of the personal computer 2000, the smartphone 3000, and the projection-type display apparatus 4000 described above includes the electro-optical device 1 described above, and can thus improve image quality of a display image.

Note that, in addition to the apparatuses exemplified in FIGS. 10, 11, and 12, examples of electronic apparatuses to which the present disclosure is applied include a PDA (Personal Digital Assistants), a digital still camera, a television, a video camera, a car navigation device, an on-board indicator, an electronic organizer, electronic paper, a calculator, a word processor, a workstation, a television phone, a POS (Point of sale) terminal, and the like. Other examples of electronic apparatuses to which the present disclosure is applied further include an apparatus and the like including a printer, a scanner, a copier, a video player, or a touch panel.

The electro-optical device and the electronic apparatus of the present disclosure are not limited to each of the exemplary embodiments described above. In addition, the configuration of each component of the present disclosure may be replaced with any configuration that exerts the equivalent functions of the above-described exemplary embodiments, and to which any configuration may be added.

What is claimed is:

1. An electro-optical device, comprising:

a first signal line, a second signal line, and a third signal line;

a signal line drive circuit configured to supply a first image signal, a polarity of which is inverted with reference to a predetermined voltage in a predetermined cycle, to the first signal line in a first writing period, supply a second image signal, a polarity of which is inverted with reference to the predetermined voltage in a predetermined cycle, to the second signal line in a second writing period after the first writing period, and supply a third image signal, a polarity of which is inverted with reference to the predetermined voltage in a predetermined cycle, to the third signal line in a third writing period after the second writing period;

a pre-charge circuit that includes a one-channel type transistor and is configured to supply a pre-charge signal to the third signal line in a pre-charge period overlapping the second writing period; and a timing control circuit configured to change a start timing of the pre-charge period in accordance with the polarity of the first image signal and to have the start timing of the pre-charge period when the polarity of the first image signal is positive to be different from the start timing of the pre-charge period when the polarity of the first image signal is negative.

2. The electro-optical device according to claim 1, wherein the one-channel type transistor is an N-channel type transistor that receives a pre-charge signal at one of a source and a drain and is coupled to the third signal line at the other the source and the drain, and when the polarity of the first image signal is a positive polarity, the timing control circuit advances a start timing of the pre-charge period as compared to a case when the polarity of the first image signal is a negative polarity.

3. The electro-optical device according to claim 1, wherein when the polarity of the first image signal is a positive polarity, the timing control circuit starts the pre-charge period after an end of the first writing period before a start of the second writing period.

4. The electro-optical device according to claim 1, wherein the timing control circuit changes a length of the pre-charge period in accordance with the polarity of the first image signal.

5. The electro-optical device according to claim 4, wherein the signal line drive circuit includes a first N-channel type transistor that receives the first image signal at one of a source and a drain and has the other coupled to the first signal line, a second N-channel type transistor that receives the second image signal at one of a source and a drain and has the other coupled to the second signal line, and a third N-channel type transistor that receives the third image signal at one of a source and a drain and has the other coupled to the third signal line, and when the polarity of the first image signal is a negative polarity, the timing control circuit shortens a length of the pre-charge period as compared to a case when the polarity of the first image signal is a positive polarity.

6. An electronic apparatus, comprising:

the electro-optical device according to claim 1.

7. An electro-optical device, comprising:

a first signal line, a second signal line, and a third signal line;

a signal line drive circuit configured to supply a first image signal, a polarity of which is inverted with reference to a predetermined voltage in a predetermined cycle, to the first signal line in a first writing period, supply a second image signal, a polarity of which is inverted with reference to the predetermined voltage in a predetermined cycle, to the second signal line in a second writing period after the first writing period, and supply a third image signal, a polarity of which is inverted with reference to the predetermined voltage in a predetermined cycle, to the third signal line in a third writing period after the second writing period;

a pre-charge circuit that includes a one-channel type transistor and is configured to supply a pre-charge signal to the third signal line in a pre-charge period overlapping the second writing period; and a timing control circuit configured to change a length of the pre-charge period in accordance with the polarity of the first image signal and to have the length of the pre-charge period when the polarity of the first image signal is positive to be different from the length of the pre-charge period when the polarity of the first image signal is negative.

8. A driving method of an electro-optical device that comprises:

a first signal line, a second signal line, and a third signal line;

a signal line drive circuit configured to supply a first image signal, a polarity of which is inverted with reference to a predetermined voltage in a predetermined cycle, to the first signal line in a first writing period, supply a second image signal, a polarity of which is inverted with reference to the predetermined voltage in a predetermined cycle, to the second signal line in a second writing period after the first writing period, and supply a third image signal, a polarity of which is inverted with reference to the predetermined voltage in a predetermined cycle, to the third signal line in a third writing period after the second writing period; and a pre-charge circuit that includes a one-channel type transistor and is configured to supply a pre-charge signal to the third signal line in a pre-charge period overlapping the second writing period, the driving method of an electro-optical device comprising changing a start timing of the pre-charge period in accordance with the polarity of the first image signal and having the start timing of the pre-charge period when the polarity of the first image signal is positive to be different from the start timing of the pre-charge period when the polarity of the first image signal is negative.

9. A driving method of an electro-optical device that comprises:

a first signal line, a second signal line, and a third signal line;

a signal line drive circuit configured to supply a first image signal, a polarity of which is inverted with reference to a predetermined voltage in a predetermined cycle, to the first signal line in a first writing period, supply a second image signal, a polarity of which is inverted with reference to the predetermined voltage in a predetermined cycle, to the second signal line in a second writing period after the first writing period, and supply a third image signal, a polarity of which is inverted with reference to the predetermined voltage in a predetermined cycle, to the third signal line in a third writing period after the second writing period; and a pre-charge circuit that includes a one-channel type transistor and is configured to supply a pre-charge signal to the third signal line in a pre-charge period overlapping the second writing period, the driving method of an electro-optical device comprising changing a length of the pre-charge period in accordance with the polarity of the first image signal and having the length of the pre-charge period when the polarity of the first image signal is positive to be different from the length of the pre-charge period when the polarity of the first image signal is negative.

* * * * *